US008622720B2

(12) United States Patent
Simmons et al.

(10) Patent No.: US 8,622,720 B2
(45) Date of Patent: Jan. 7, 2014

(54) RECIPROCATING FLUID PUMPS INCLUDING MAGNETS AND RELATED METHODS

(75) Inventors: Tom M. Simmons, Kamas, UT (US); John M. Simmons, Marion, UT (US); David M. Simmons, Francis, UT (US); Kenji Allen Kingsford, Heber, UT (US)

(73) Assignees: Tom M. Simmons, Kamas, UT (US); John M. Simmons, Marion, UT (US); David M. Simmons, Francis, UT (US)

( * ) Notice: Subject to any disclaimer, the term of this patent is extended or adjusted under 35 U.S.C. 154(b) by 0 days.

(21) Appl. No.: 13/228,934

(22) Filed: Sep. 9, 2011

(65) Prior Publication Data

US 2012/0063924 A1 Mar. 15, 2012

Related U.S. Application Data

(60) Provisional application No. 61/381,387, filed on Sep. 9, 2010.

(51) Int. Cl.
*F04B 43/10* (2006.01)

(52) U.S. Cl.
USPC ..... 417/394; 417/347; 417/472

(58) Field of Classification Search
USPC ..... 417/245–246, 254–255, 258, 267, 384, 417/391–397, 399, 340, 347, 472; 91/420, 91/520, 304–314; 92/34–50, 172–260, 92/130 R, 131, 133, 130 B; 29/888.02
See application file for complete search history.

(56) References Cited

U.S. PATENT DOCUMENTS

| | | | | | |
|---|---|---|---|---|---|
| 2,671,449 | A | * | 3/1954 | Dann | 604/193 |
| 2,889,782 | A | * | 6/1959 | Smith | 417/471 |
| 3,304,126 | A | * | 2/1967 | Rupp et al. | 406/96 |
| 4,519,792 | A | * | 5/1985 | Dawe | 604/152 |
| 5,001,412 | A | * | 3/1991 | Carter et al. | 322/10 |
| 5,203,172 | A | | 4/1993 | Simpson et al. | |
| 5,222,876 | A | * | 6/1993 | Budde | 417/393 |
| 5,269,663 | A | * | 12/1993 | Cuniberti | 417/356 |
| 5,370,507 | A | | 12/1994 | Dunn et al. | |
| 5,558,506 | A | | 9/1996 | Simmons et al. | |
| 5,784,948 | A | * | 7/1998 | Chrestoff et al. | 92/57 |
| 5,893,707 | A | | 4/1999 | Simmons et al. | |
| 5,936,613 | A | * | 8/1999 | Jaeger et al. | 345/172 |
| 5,947,001 | A | * | 9/1999 | Evans et al. | 92/5 R |

(Continued)

OTHER PUBLICATIONS

International Search Report and Written Opinion for PCT Application No. PCT/US2011/050987, mailed May 1, 2012, 7 pages.

*Primary Examiner* — Peter J Bertheaud
*Assistant Examiner* — Dnyanesh Kasture
(74) *Attorney, Agent, or Firm* — TraskBritt

(57) ABSTRACT

Reciprocating fluid pumps include a plunger configured to expand and compress in a reciprocating action to pump fluid, and one or more magnets carried by the plunger. The one or more magnets may be used to impart a force on the plunger when the plunger expands and compresses in the reciprocating action within a pump body responsive to a magnetic field. Shuttle valves for shifting flow of pressurized fluid between at least two conduits include a spool movable within a valve body and one or more magnets carried by the spool. The one or more magnets may be used to impart a force on the spool responsive to a magnetic field. Reciprocating fluid pumps may include such shuttle valves. Methods include forming and using such pumps and shuttle valves.

27 Claims, 8 Drawing Sheets

(56) References Cited

U.S. PATENT DOCUMENTS

| | | | | |
|---|---|---|---|---|
| 6,106,246 | A | 8/2000 | Steck et al. | |
| 6,295,918 | B1 | 10/2001 | Simmons et al. | |
| 6,388,352 | B1 * | 5/2002 | Huang | 310/152 |
| 6,532,916 | B2 * | 3/2003 | Kerrebrock | 123/46 E |
| 6,685,443 | B2 | 2/2004 | Simmons et al. | |
| 7,458,309 | B2 * | 12/2008 | Simmons et al. | 91/230 |
| 2001/0003802 | A1 * | 6/2001 | Vitale | 623/3.11 |
| 2005/0100453 | A1 * | 5/2005 | Kinugawa | 417/395 |
| 2007/0266846 | A1 | 11/2007 | Simmons et al. | |
| 2008/0250919 | A1 * | 10/2008 | Strong | 91/304 |
| 2009/0142205 | A1 * | 6/2009 | Yajima | 417/375 |
| 2010/0178184 | A1 * | 7/2010 | Simmons et al. | 417/472 |

* cited by examiner

RECIPROCATING FLUID PUMPS INCLUDING MAGNETS AND RELATED METHODS

CROSS-REFERENCE TO RELATED APPLICATION

This application claims the benefit of U.S. Provisional Patent Application Ser. No. 61/381,387, filed Sep. 9, 2010 and entitled "Fluid Pumps Including Magnets, Devices Including Magnets For Use With Fluid Pumps, And Related Methods," the disclosure of which is incorporated herein in its entirety by this reference.

TECHNICAL FIELD

Embodiments of the present invention relate generally to reciprocating fluid pumps that include a reciprocating plunger, to components and devices for use with such pumps, and to methods of making and using such reciprocating fluid pumps and devices.

BACKGROUND

Reciprocating fluid pumps are used in many industries. Reciprocating fluid pumps generally include two fluid chambers in a pump body. A reciprocating piston or shaft is driven back and forth within the pump body. One or more plungers (e.g., diaphragms or bellows) may be connected to the reciprocating piston or shaft. As the reciprocating piston moves in one direction, the movement of the plungers results in fluid being drawn into a first fluid chamber of the two fluid chambers and expelled from the second chamber. As the reciprocating piston moves in the opposite direction, the movement of the plungers results in fluid being expelled from the first chamber and drawn into the second chamber. A chamber inlet and a chamber outlet may be provided in fluid communication with the first fluid chamber, and another chamber inlet and another chamber outlet may be provided in fluid communication with the second fluid chamber. The chamber inlets to the first and second fluid chambers may be in fluid communication with a common single pump inlet, and the chamber outlets from the first and second fluid chambers may be in fluid communication with a common single pump outlet, such that fluid may be drawn into the pump through the pump inlet from a single fluid source, and fluid may be expelled from the pump through a single pump outlet. Check valves may be provided at the chamber inlet and outlet of each of the fluid chambers to ensure that fluid can only flow into the fluid chambers through the chamber inlets, and fluid can only flow out of the of the fluid chambers through the chamber outlets.

Examples of such reciprocating fluid pumps are disclosed in, for example, U.S. Pat. No. 5,370,507, which issued Dec. 6, 1994 to Dunn et al., U.S. Pat. No. 5,558,506, which issued September 24, 1996 to Simmons et al., U.S. Pat. No. 5,893,707, which issued Apr. 13, 1999 to Simmons et al., U.S. Pat. No. 6,106,246, which issued Aug. 22, 2000 to Steck et al., U.S. Pat. No. 6,295,918, which issued Oct. 2, 2001 to Simmons et al., U.S. Pat. No. 6,685,443, which issued Feb. 3, 2004 to Simmons et al., U.S. Pat. No. 7,458,309, which issued Dec. 2, 2008 to Simmons et al., and U.S. Patent Application Publication No. 2010/0178184 A1, which published Jul. 15, 2010 in the name of Simmons et al., the disclosure of each of which patents and patent application is respectively incorporated herein in its entirety by this reference.

DETAILED DESCRIPTION

The illustrations presented herein may not be, in some instances, actual views of any particular reciprocating fluid pump or component thereof, but may be merely idealized representations that are employed to describe embodiments of the present invention. Additionally, elements common between figures may retain the same numerical designation.

As used herein, the term "substantially" means and includes to a degree that one skilled in the art would understand the given parameter, property, or condition is met with a small degree of variance, such as within acceptable manufacturing tolerances.

As used herein, the term "magnet" means and includes any object or device that produces a magnetic field. Magnets include permanent magnets and electromagnetic devices.

As used herein, the phrase "permanent magnet" means and includes any object or device comprising a material that is magnetized and creates its own persistent magnetic field.

As used herein, the phrase "electromagnetic device" means and includes any device used to generate a magnetic field resulting by flowing electrical current through a conductive wire or other structure.

As used herein, the phrase "magnetic material" means and includes any material that alters and/or responds to a magnetic field proximate to the magnetic material. For example, a "magnetic material" may comprise at least one of a magnet and a ferrous material.

As used herein, the phrase "non-magnetic material" means and includes any material that does not alter and/or respond to a magnetic field proximate to the non-magnetic material. For example, a "non-magnetic material" may comprise a polymer.

As used herein, the terms "proximate" and "adjacent," when referencing a location of a magnetic field with respect to a magnet carried by a movable element, mean and include a distance within which a magnet associated with the movable element imparts a perceptible motive force to that element.

Figure 1:
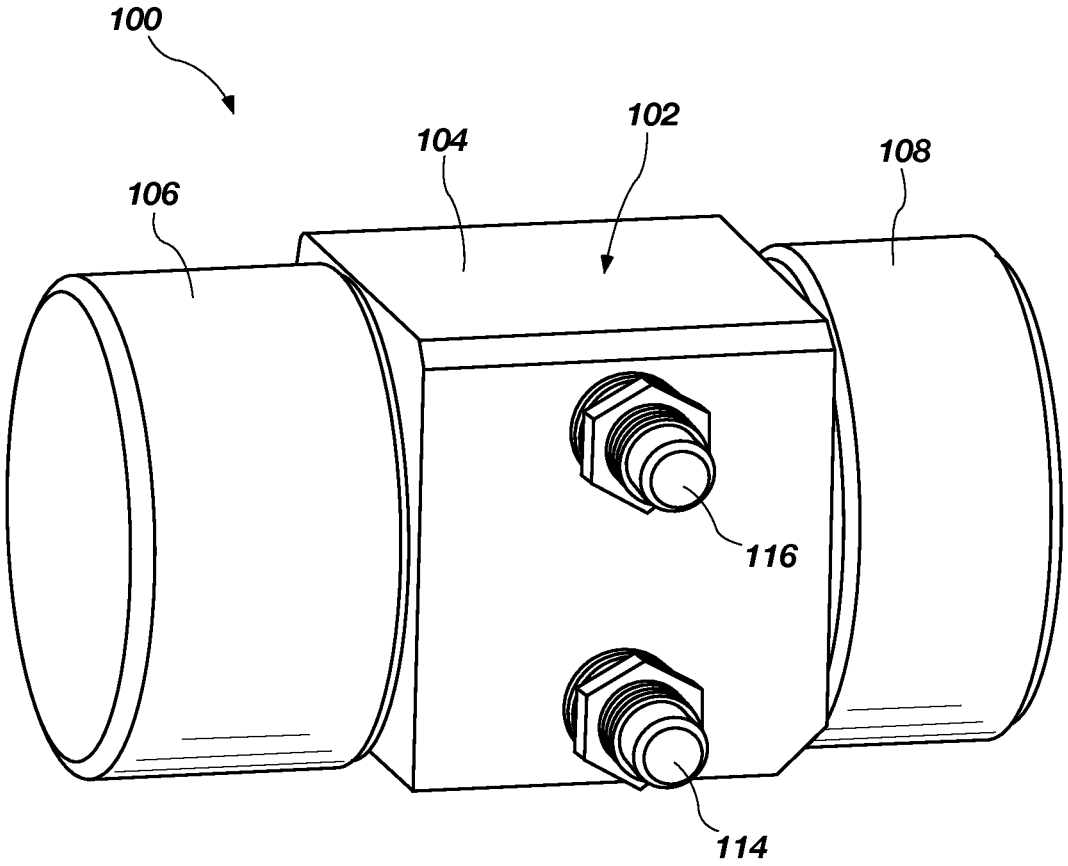
FIG. 1 is a perspective view of an example embodiment of a reciprocating fluid pump of the invention.

FIG. 1 illustrates an embodiment of a reciprocating fluid pump 100 of the present invention. In some embodiments, the reciprocating fluid pump 100 is configured to pump a subject fluid, such as, for example, a liquid (e.g., water, oil, acid, etc.), gas, or powdered substance, using a pressurized drive fluid such as, for example, compressed gas (e.g., air). Thus, in some embodiments, the reciprocating fluid pump 100 may comprise a pneumatically operated liquid pump.

The reciprocating fluid pump 100 includes a pump body 102, which may comprise two or more components that may be assembled together to form the pump body 102. For example, the pump body 102 may include a center body 104, a first end piece 106 that may be attached to the center body 104 on a first side thereof, and a second end piece 108 that may be attached to the center body 104 on an opposite, second side thereof.

Figure 2:
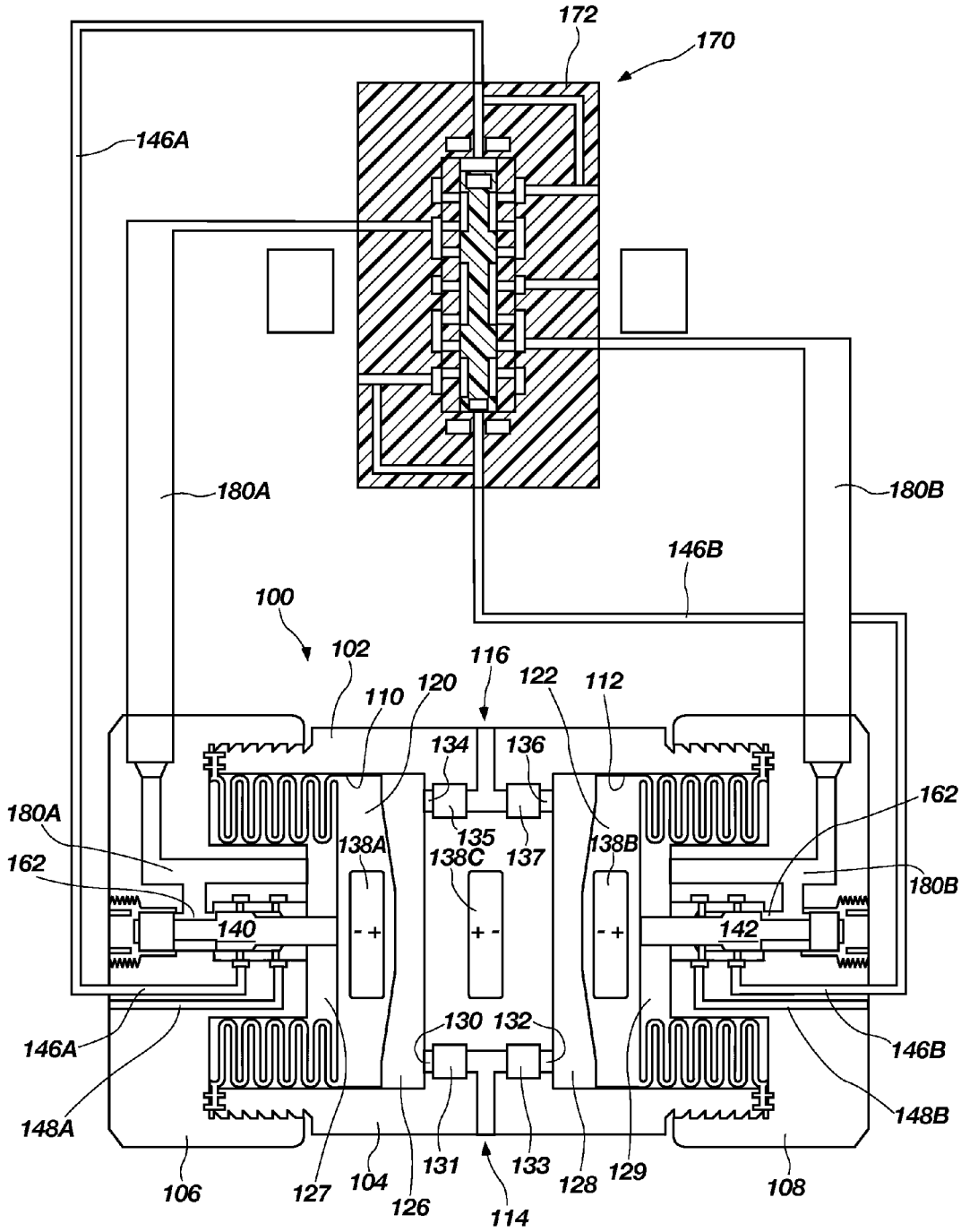
FIG. 2 is a schematically illustrated cross-sectional view of the reciprocating fluid pump shown in FIG. 1, and further includes a schematically illustrated cross-sectional view of a shuttle valve that may be used in conjunction with the reciprocating fluid pump.

FIG. 2 includes a schematic cross-sectional illustration of the reciprocating fluid pump 100. As shown in FIG. 2, the pump body 102 may include therein a first cavity 110 and a second cavity 112. A first plunger 120 may be disposed within the first cavity 110, and a second plunger 122 may be disposed within the second cavity 112. The plungers 120, 122 may each be formed of and comprise a flexible polymer material (e.g., an elastomer or a thermoplastic material). As discussed in further detail below, each of the plungers 120, 122 may comprise, for example, a diaphragm or a bellows (as shown in the figures), such that the plungers 120, 122 may be longitudinally extended and compressed as the reciprocating fluid pump 100 is cycled (i.e., in the left and right horizontal directions from the perspective of FIG. 2) during operation thereof. The first plunger 120 may divide the first cavity 110 into a first subject fluid chamber 126 on a first side of the first plunger 120 and a first drive fluid chamber 127 on an opposite, second side of the first plunger 120. Similarly, the second plunger 122 may divide the second cavity 112 into a second subject fluid chamber 128 on a first side of the second plunger 122 and a second drive fluid chamber 129 on an opposite, second side of the second plunger 122.

A peripheral edge of the first plunger 120 may be attached to the pump body 102, and a fluid tight seal may be provided between the pump body 102 and the first plunger 120. Similarly, a peripheral edge of the second plunger 122 may be attached to the pump body 102, and a fluid tight seal may be provided between the pump body 102 and the second plunger 122. The reciprocating fluid pump 100 includes a subject fluid inlet 114 and a subject fluid outlet 116. During operation of the reciprocating fluid pump 100, subject fluid may be drawn into the reciprocating fluid pump 100 through the subject fluid inlet 114 and expelled out from the reciprocating fluid pump 100 through the subject fluid outlet 116.

A first subject fluid inlet 130 may be provided in the pump body 102 that leads from the subject fluid inlet 114 into the first subject fluid chamber 126 through the pump body 102, and a first subject fluid outlet 134 may be provided in the pump body 102 that leads out from the first subject fluid chamber 126 to the subject fluid outlet 116 through the pump body 102. Similarly, a second subject fluid inlet 132 may be provided in the pump body 102 that leads from the subject fluid inlet 114 into the second subject fluid chamber 128 through the pump body 102, and a second subject fluid outlet 136 may be provided in the pump body 102 that leads out from the second subject fluid chamber 128 to the subject fluid outlet 116 through the pump body 102. Furthermore, a first subject fluid inlet check valve 131 may be provided proximate the first subject fluid inlet 130 to ensure that fluid is capable of flowing into the first subject fluid chamber 126 through the first subject fluid inlet 130, but incapable of flowing out from the first subject fluid chamber 126 through the first subject fluid inlet 130. A first subject fluid outlet check valve 135 may be provided proximate the first subject fluid outlet 134 to ensure that fluid is capable of flowing out from the first subject fluid chamber 126 through the first subject fluid outlet 134, but incapable of flowing into the first subject fluid chamber 126 through the first subject fluid outlet 134. Similarly, a second subject fluid inlet check valve 133 may be provided proximate the second subject fluid inlet 132 to ensure that fluid is capable of flowing into the second subject fluid chamber 128 through the second subject fluid inlet 132, but incapable of flowing out from the second subject fluid chamber 128 through the second subject fluid inlet 132. A second subject fluid outlet check valve 137 may be provided proximate the second subject fluid outlet 136 to ensure that fluid is capable of flowing out from the second subject fluid chamber 128 through the second subject fluid outlet 136, but incapable of flowing into the second subject fluid chamber 128 through the second subject fluid outlet 136. Each of the check valves 131, 133, 135, and 137 may be any suitable valve that allows flow in one direction and restricts flow in an opposite direction, such as, for example, a ball check valve, a diaphragm check valve, a magnet check valve, etc.

Figure 3:
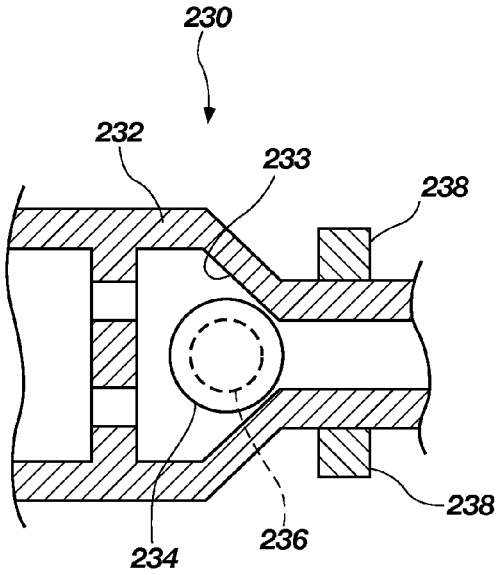
FIG. 3 is a schematically illustrated cross-sectional view of an example embodiment of a magnet check valve of the invention.

FIG. 3 shows an embodiment of a magnet check valve 230 of the present disclosure that employs the use of one or more magnets to assist in restricting flow in at least one direction. The magnet check valve 230 may include a valve housing 232 with a valve seat 233. A ball 234 may be configured to seal against the valve seat 233 of the valve housing 232 to restrict flow through the valve housing 232 in at least one direction (e.g., from left to right in the perspective of FIG. 3). The ball 234 may comprise a magnet and/or a magnetic material (e.g., a ferrous material). For example, the ball 234 may include an internal magnet 236 surrounded by a non-magnetic material (e.g., a polymer). In other embodiments, the entire ball 234 may be formed of a magnet. The magnet check valve 230 may also include an external magnet 238 configured to magnetically pull on the ball 234 to force it against the valve seat 233. The external magnet 238 may comprise a permanent magnet or an electromagnetic device. By way of example and not limitation, the external magnet 238 may encircle an outer surface of the valve housing 232. The configuration of the magnet check valve 230 may be tailored to allow flow through the magnet check valve 230 from right to left (from the perspective of FIG. 3) at a predetermined pressure and/or flow rate. For example, when sufficient fluid pressure is present on the right side (from the perspective of FIG. 3) of the ball 234, the magnetic force between the external magnet 238 and the internal magnet 236 may be overcome and the ball 234 may be forced away from the valve seat 233 to open the magnet check valve 230 and allow flow therethrough. When such pressure and/or flow falls below a certain level, the external magnet 238 may pull on the internal magnet 236 of the ball 234 and the ball 234 may seal against the valve seat 233 again. In this manner the internal magnet 236 and the external magnet 238 may work to restrict flow through the magnet check valve 230 from the left to the right (from the perspective of FIG. 3).

Although the magnet check valve 230 of FIG. 3 is shown by way of example with a ball 234 that seals against the valve seat 233 to close the magnet check valve 230, the present disclosure is not so limited. For example, a magnet check valve of the present disclosure may be a diaphragm or other type check valve that includes at least one magnet configured to assist in the sealing of the check valve and restricting flow therethrough in at least one direction.

Referring again to FIG. 2, the subject fluid inlets 130, 132 leading to the first subject fluid chamber 126 and the second subject fluid chamber 128, respectively, may be in fluid communication with the subject fluid inlet 114, and the subject fluid outlets 134, 136 leading out from the first subject fluid chamber 126 and the second subject fluid chamber 128 may be in fluid communication with the subject fluid outlet 116, such that subject fluid may be drawn into the reciprocating fluid pump 100 through the subject fluid inlet 114 from a single fluid source, and subject fluid may be expelled from the reciprocating fluid pump 100 through the subject fluid outlet 116.

In the configuration described above, the first plunger 120 is capable of extending in the rightward direction and compressing in the leftward direction from the perspective of FIG. 2. Similarly, the second plunger 122 is capable of extending in the leftward direction and compressing in the rightward direction from the perspective of FIG. 2.

As the first plunger 120 extends and the second plunger 122 compresses, the volume of the first drive fluid chamber 127 increases, the volume of the first subject fluid chamber 126 decreases, the volume of the second subject fluid chamber 128 increases, and the volume of the second drive fluid chamber 129 decreases. As a result, subject fluid may be expelled from the first subject fluid chamber 126 through the first subject fluid outlet 134, and subject fluid may be drawn into the second subject fluid chamber 128 through the second subject fluid inlet 132. The first plunger 120 may be extended and the second plunger 122 may be compressed by providing pressurized drive fluid within the first drive fluid chamber 127. One or more magnetic devices may be used to compress, or at least assist in compression of the second plunger 122 responsive to extension of the first plunger 120, as discussed in further detail below.

Conversely, as the second plunger 122 extends and the first plunger 120 compresses, the volume of the second drive fluid chamber 129 increases, the volume of the second subject fluid chamber 128 decreases, the volume of the first subject fluid chamber 126 increases, and the volume of the first drive fluid chamber 127 decreases. As a result, subject fluid may be expelled from the second subject fluid chamber 128 through the second subject fluid outlet 136, and subject fluid may be drawn into the first subject fluid chamber 126 through the first subject fluid inlet 130. The second plunger 122 may be extended and the first plunger 120 may be compressed by providing pressurized drive fluid within the second drive fluid chamber 129. One or more magnetic devices may be used to compress, or at least assist in compression of the first plunger 120 responsive to extension of the second plunger 122, as discussed in further detail below.

As shown in FIG. 2, the reciprocating fluid pump 100 may include one or more magnets. For example, the reciprocating fluid pump 100 may include at least one magnet carried by at least one of the first plunger 120 and the second plunger 122, and the at least one magnet may be located and configured to impart a force on the at least one of the first plunger 120 and the second plunger 122 when the plunger 120, 122 expands and compresses in the reciprocating action within the pump body 102 responsive to a proximate magnetic field, which may be generated by another magnet. The another magnet may be a permanent magnet or an electromagnetic device, and may be disposed in or on the pump body 102 or outside the pump body 102.

In the embodiment of FIG. 2, the reciprocating fluid pump 100 includes a first magnet 138A carried by the first plunger 120, a second magnet 138B carried by the second plunger 122, and a third magnet 138C disposed within the pump body 102. The third magnet 138C may be disposed within the center body 104 between the first plunger 120 and the second plunger 122, as shown in FIG. 2. The third magnet 138C may be a permanent magnet or an electromagnetic device. The first plunger 120 may comprise a tubular body having a first closed end and an opposite, second open end. The tubular body of the first plunger 120 may have an end wall at the first closed end and a sidewall extending from the end wall toward the opposite, second open end of the tubular body. The first magnet 138A may be carried by the end wall at the first closed end of the tubular body of the first plunger 120. Similarly, the second plunger 122 may comprise a tubular body having a first closed end and an opposite, second open end. The tubular body of the second plunger 122 may have an end wall at the first closed end and a sidewall extending from the end wall toward the opposite, second open end of the tubular body. The second magnet 138B may be carried by the end wall at the first closed end of the tubular body of the second plunger 122.

Each of the magnets 138A, 138B, 138C may comprise, for example, a permanent magnet that is at least substantially comprised of a magnetic material. The magnetic material may comprise, for example, a rare earth element (i.e., each of the magnets 138A, 138B, 138C may comprise a permanent rare earth magnet). As non-limiting examples, the magnetic material may comprise at least one of a samarium cobalt alloy and a neodymium iron alloy. In some embodiments, the pump body 102 and other components of the reciprocating fluid pump 100, with the exception of the magnets 138A, 138B, 138C, may be at least substantially comprised of a non-magnetic material, such as a polymer and/or a non-magnetic metal. By way of example and not limitation, such a polymer may comprise one or more of a fluoropolymer, neoprene, buna-N, ethylene diene M-class (EPDM), VITON®, polyurethane, HYTREL®, SANTOPRENE®, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), NORDEL™, and nitrile. By way of example and not limitation, such a non-magnetic metal may comprise one or more of a stainless steel, INCONEL®, MONEL®, HASTELLOY®, a high nickel alloy, brass, copper, bronze, aluminum, and zinc.

The magnets 138A, 138B, 138C may be located, oriented, and configured to impart a force on each of the plungers 120, 122 as the plungers 120, 122 expand and compress in the reciprocating action within the pump body 102.

For example, the first magnet 138A carried by the first plunger 120 may be located and oriented to impart a force on the first plunger 120 responsive to a proximate magnetic field provided by the third magnet 138C within the pump body 102 when the first plunger 120 expands and compresses in the reciprocating action within the pump body 102. For example, the first magnet 138A carried by the first plunger 120 and the third magnet 138C disposed within the pump body 102 may be located along and centered about a common axis along which the first plunger 120 expands and compresses, and may be oriented such that the polarity of the first magnet 138A is opposite the polarity of the third magnet 138C. In other words, the magnetic moment vector of the first magnet 138A may extend in a direction opposite to the magnetic moment vector of the third magnet 138C. Further, the magnetic moment vector of the first magnet 138A may be parallel to and aligned along a common axis (e.g., the axis along which the first plunger 120 expands and compresses) with the magnetic moment vector of the third magnet 138C. In this configuration, a repulsive force will be applied between the first magnet 138A and the third magnet 138C, the magnitude of which will increase as the first magnet 138A and the third magnet 138C are brought into proximity with one another during operation of the reciprocating fluid pump 100. The third magnet 138C may be disposed in a fixed location within the pump body 102 such that the third magnet 138C does not move during operation of the reciprocating fluid pump 100. Thus, as the first magnet 138A is carried by the first plunger 120, the force applied to the first magnet 138A by the proximate magnetic field of the third magnet 138C will be translated and applied to the first plunger 120. As a result, a force will be applied to the first plunger 120 by the proximate magnetic field of the third magnet 138C that urges the plunger 120 to compress, which causes the volume of the first subject fluid chamber 126 to expand and the volume of the first drive fluid chamber 127 to contract.

The first magnet 138A and the third magnet 138C may be configured such that the force acting on the first plunger 120 by the first magnet 138A and the third magnet 138C is sufficient to cause the first plunger 120 to compress, the volume of the first subject fluid chamber 126 to expand, and the volume of the first drive fluid chamber 127 to contract in the absence of the pressurization of the first drive fluid chamber 127 as described herein, but not so high as to prevent extension of the first plunger 120, contraction of the volume of the first subject fluid chamber 126, and expansion of the volume of the first drive fluid chamber 127 when the first drive fluid chamber 127 is pressurized with drive fluid, as described herein.

Similarly, the second magnet 138B carried by the second plunger 122 may be located and oriented to impart a force on the second plunger 122 responsive to a proximate magnetic field provided by the third magnet 138C within the pump body 102 when the second plunger 122 expands and compresses in the reciprocating action within the pump body 102. For example, the second magnet 138B carried by the second plunger 122 and the third magnet 138C disposed within the pump body 102 may be located along and centered about a common axis along which the second plunger 122 expands and compresses, and may be oriented such that the polarity of the second magnet 138B is opposite the polarity of the third magnet 138C. In other words, the magnetic moment vector of the second magnet 138B may extend in a direction opposite to the magnetic moment vector of the third magnet 138C. Further, the magnetic moment vector of the second magnet 138B may be parallel to and aligned along a common axis (e.g., the axis along which the second plunger 122 expands and compresses) with the magnetic moment vector of the third magnet 138C. In this configuration, a repulsive force will be applied between the second magnet 138B and the third magnet 138C, the magnitude of which will increase as the second magnet 138B and the third magnet 138C are brought into proximity with one another during operation of the reciprocating fluid pump 100. As mentioned above, the third magnet 138C may be disposed in a fixed location within the pump body 102 such that the third magnet 138C does not move during operation of the reciprocating fluid pump 100. Thus, as the second magnet 138B is carried by the second plunger 122, the force applied to the second magnet 138B by the proximate magnetic field of the third magnet 138C will be translated and applied to the second plunger 122. As a result, a force will be applied to the second plunger 122 by the proximate magnetic field of the third magnet 138C that urges the second plunger 122 to compress, which causes the volume of the second subject fluid chamber 128 to expand and the volume of the second drive fluid chamber 129 to contract.

The second magnet 138B and the third magnet 138C may be configured such that the force acting on the second plunger 122 by the second magnet 138B and the third magnet 138C is sufficient to cause the second plunger 122 to compress, the volume of the second subject fluid chamber 128 to expand, and the volume of the second drive fluid chamber 129 to contract in the absence of the pressurization of the second drive fluid chamber 129 as described herein, but not so high as to prevent extension of the second plunger 122, contraction of the volume of the second subject fluid chamber 128, and expansion of the volume of the second drive fluid chamber 129 when the second drive fluid chamber 129 is pressurized with drive fluid, as described herein.

Although the third magnet 138C has been shown and described as a magnet (e.g., a permanent magnet, an electromagnetic device), other configurations are also contemplated by the present disclosure. For example, in some embodiments, a magnetic material (e.g., a ferrous material) may be used in place of or in addition to the third magnet 138C.

In additional embodiments, a magnet (e.g., a permanent magnet or an electromagnetic device) located at least partially outside the pump body 102 may be used to provide the proximate magnetic field for generating forces acting on the first magnet 138A and the first plunger 120, and on the second magnet 138B and the second plunger 122. Furthermore, in additional embodiments, a plurality of magnets may be carried by each of the first plunger 120 and the second plunger 122. Similarly, a plurality of magnets may be used to provide a net proximate magnetic field for generating forces acting on the magnet or magnets carried by the first plunger 120 and on the magnet or magnets carried by the second plunger 122.

The first drive fluid chamber 127 may be pressurized with pressurized drive fluid, which will push the first plunger 120 to the right (from the perspective of FIG. 2). As the first plunger 120 moves to the right, the second drive fluid chamber 129 is depressurized (e.g., vented to ambient, a reduced pressure, or even a vacuum) and, as a result, the second magnet 138B and the second plunger 122 are pushed to the right responsive to the proximate magnetic field provided by the third magnet 138C disposed within the pump body 102. As the first plunger 120 and the second plunger 122 move to the right (from the perspective of FIG. 2), any subject fluid within the first subject fluid chamber 126 will be expelled from the first subject fluid chamber 126 through the first subject fluid outlet 134, and subject fluid will be drawn into the second subject fluid chamber 128 through the second subject fluid inlet 132.

The second drive fluid chamber 129 may be pressurized with pressurized drive fluid, which will push the second plunger 122 to the left (from the perspective of FIG. 2). As the second plunger 122 moves to the left, the first drive fluid chamber 127 is depressurized (e.g., vented to ambient, a reduced pressure, or even a vacuum) and, as a result, the first magnet 138A and the first plunger 120 are pushed to the left responsive to the proximate magnetic field provided by the third magnet 138C disposed within the pump body 102. As the first plunger 120 and the second plunger 122 move to the left (from the perspective of FIG. 2), any subject fluid within the second subject fluid chamber 128 will be expelled from the second subject fluid chamber 128 through the second subject fluid outlet 136, and subject fluid will be drawn into the first subject fluid chamber 126 through the first subject fluid inlet 130.

Thus, to drive the pumping action of the reciprocating fluid pump 100, the first drive fluid chamber 127 and the second drive fluid chamber 129 may be pressurized in an alternating or cyclic manner to cause the first plunger 120 and the second plunger 122 to reciprocate back and forth within the pump body 102, as discussed above.

The reciprocating fluid pump 100 may comprise a shifting mechanism for shifting the flow of pressurized drive fluid back and forth between the first drive fluid chamber 127 and the second drive fluid chamber 129. The shifting mechanism may comprise, for example, one or more shift pistons 140, 142 and a shuttle valve 170, as discussed in further detail below.

As shown in FIG. 2, a first shift piston 140 may be disposed within the pump body 102 proximate and adjacent the first plunger 120, and a second shift piston 142 may be disposed within the pump body 102 proximate and adjacent the second plunger 122. Each of the shift pistons 140, 142 may comprise an elongated, generally cylindrical body that is oriented generally parallel to the axis along which each of the first plunger 120 and the second plunger 122 extends and compresses.

Figure 4:
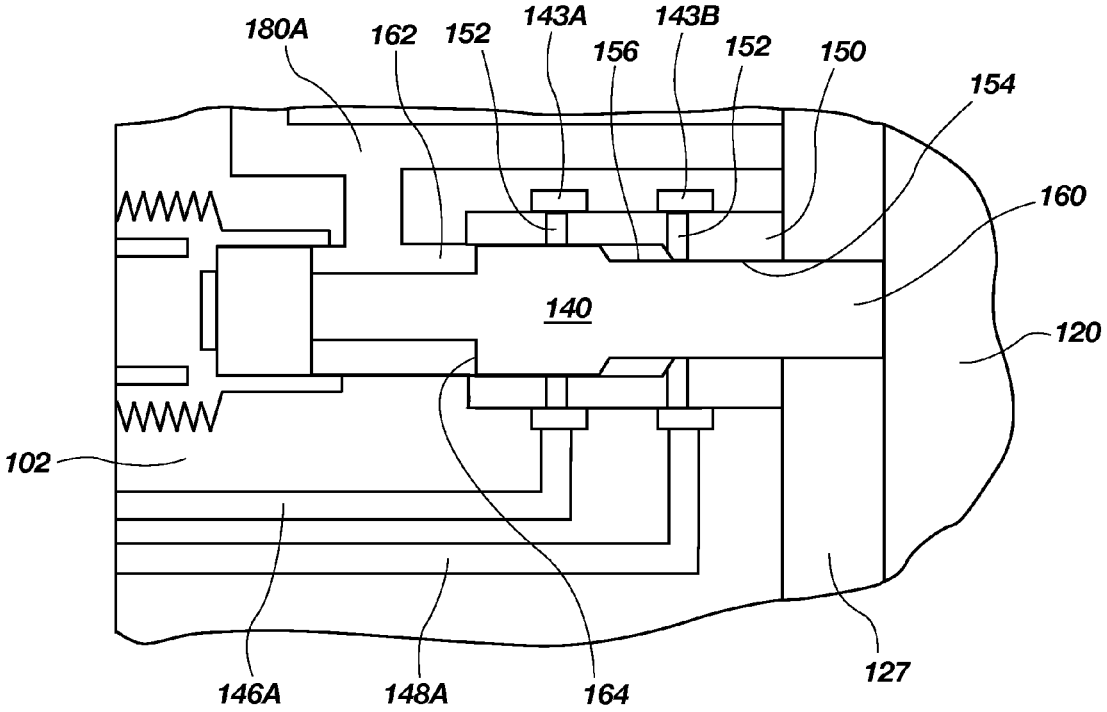
FIG. 4 is an enlarged view of a portion of FIG. 2 illustrating a shift piston of the reciprocating fluid pump.

FIG. 4 is an enlarged view of a portion of FIG. 2 including the first shift piston 140. As shown in FIG. 4, two recesses 143A, 143B may be provided in a wall of the pump body 102 within the bore extending through the pump body 102 in which the first shift piston 140 is disposed. Each of the two recesses 143A, 143B may comprise a substantially continuous annular recess that extends around the bore in the pump body 102 in which the first shift piston 140 is disposed. Thus, each of the two recesses 143A, 143B can be seen in the cross-sectional view of FIG. 4 over and under the first shift piston 140 (from the perspective of FIG. 4). A fluid conduit may lead through the pump body 102 to each of the two recesses 143A, 143B, respectively.

A first shift-shuttle conduit 146A may extend between the first recess 143A, and the shuttle valve 170. A first shift piston vent conduit 148A may extend from the second recess 143B to the exterior of the pump body 102. Although an enlarged figure of the second shift piston 142 is not provided, a second shift-shuttle conduit 146B may extend between the second shift piston 142 and the shuttle valve 170 in a manner like that of the first shift-shuttle conduit 146A, and a second shift piston vent conduit 148B may extend from the second shift piston 142 to the exterior of the pump body 102 in a manner like that of the first shift piston vent conduit 148A, as shown in FIG. 4.

With continued reference to FIG. 4, a cylindrical insert 150 may be disposed between the first shift piston 140 and the two recesses 143A, 143B in the wall of the pump body 102 within the bore in which the first shift piston 140 is disposed. One or more holes 152 may be provided through the cylindrical insert 150 in each plane transverse to the longitudinal axis of the first shift piston 140 that is aligned with one of the two recesses 143A, 143B. Thus, fluid communication is provided between the interior of the cylindrical insert 150 and each of the recesses 143A, 143B through the holes 152 in the cylindrical insert 150. Furthermore, a plurality of annular sealing members (e.g., O-rings) (not shown) optionally may be provided between the outer cylindrical surface of the cylindrical insert 150 and the adjacent wall of the pump body 102 within the bore in which the first shift piston 140 is disposed to eliminate fluid communication between the recesses 143A, 143B through any space between the cylindrical insert 150 and the pump body 102.

The first shift piston 140 may slide against a bearing surface 154 of the cylindrical insert 150 as it moves left and right (from the perspective of FIG. 4) in the reciprocating motion. The magnetic force acting between the first magnet 138A and the third magnet 138C may generally tend to force the first plunger 120 out of alignment with the first cavity 110 (FIG. 2). In some embodiments, the bearing surface 154 may be extended to the left and right (from the perspective of FIG. 4) and/or the diameter of the first shift piston 140 and the internal diameter of the bearing surface 154 may be increased to provide a greater surface area against which the first shift piston 140 may slide to maintain the first plunger 120 in alignment with the first cavity 110. Optionally, at least one bearing insert (not shown) may be provided along the bearing surface 154 to minimize friction between the first shift piston 140 and the bearing surface 154. Thus, the bearing surface 154 of the cylindrical insert 150 may be configured to maintain the first plunger 120 in substantial alignment with the first cavity 110 and to counteract the magnetic force tending to push the first plunger 120 out of alignment.

The first shift piston 140 comprises an annular recess 156 in the outer surface of the first shift piston 140. The annular recess 156 is located on the first shift piston 140, and has a length (i.e., a dimension generally parallel to the longitudinal axis of the first shift piston 140) that is sufficiently long, to cause the annular recess 156 to longitudinally overlap the second recess 143B throughout the stroke of the first shift piston 140. In this configuration, fluid communication is provided between the space surrounding the first shift piston 140 within the annular recess 156 and the exterior of the pump body 102 through the second recess 143B and the corresponding hole 152 in the cylindrical insert 150 that is aligned with the second recess 143B, which may facilitate movement of the first shift piston 140 within the pump body 102.

As shown in FIG. 4, an elongated extension 160 may be provided on a first side of the first shift piston 140 that extends at least partially into the first drive fluid chamber 127. A space 162 within the pump body 102 adjacent a shoulder surface 164 on an opposite, second side of the first shift piston 140 may be in fluid communication with the first drive chamber 127 and a first drive chamber conduit 180A that extends between the first drive chamber 127 and the shuttle valve 170, as shown in FIG. 2. A second drive chamber conduit 180B may similarly extend between a space within the pump body 102 adjacent an end surface of the second shift piston 142 and the shuttle valve 170, as shown in FIG. 2.

Referring again to FIG. 4, the elongated extension 160 of the first shift piston 140 may be located and configured such that the first plunger 120 abuts against the end of the elongated extension 160 of the first shift piston 140. When the first plunger 120 is moving to the right (from the perspectives of FIGS. 2 and 4) due to pressurization of the first drive fluid chamber 127, the fluid communication provided between the first drive fluid chamber 127 and the space 162 adjacent the shoulder surface 164 on the second side of the first shift piston 140 may force the end of the elongated extension 160 of the first shift piston 140 against the first plunger 120, and force the first shift piston 140 to also move to the right. When the first plunger 120 is moving to the left (from the perspectives of FIGS. 2 and 4) due to pressurization of the second drive fluid chamber 129, the first plunger 120 will also be forced against the end of the elongated extension 160 of the first shift piston 140 and will force the first shift piston 140 to also move to the left.

When the first shift piston 140 is moving to the right (from the perspectives of FIGS. 2 and 4), the shoulder surface 164 of the first shift piston 140 will eventually reach and pass the first recess 143A in the pump body 102 and the hole 152 in the cylindrical insert 150 that is aligned therewith. At this point, fluid communication will be provided between the first drive chamber conduit 180A and the first shift-shuttle conduit 146A through the space 162 adjacent the shoulder surface 164 of the first shift piston 140, which will send pressurized air (or other drive fluid) through the first shift-shuttle conduit 146A to the shuttle valve 170, signaling the end of a stroke of extension of the first plunger 120 and causing the first plunger 120 and the second plunger 122 to begin moving to the left (from the perspectives of FIGS. 2 and 4), as discussed in further detail below.

Figure 5:
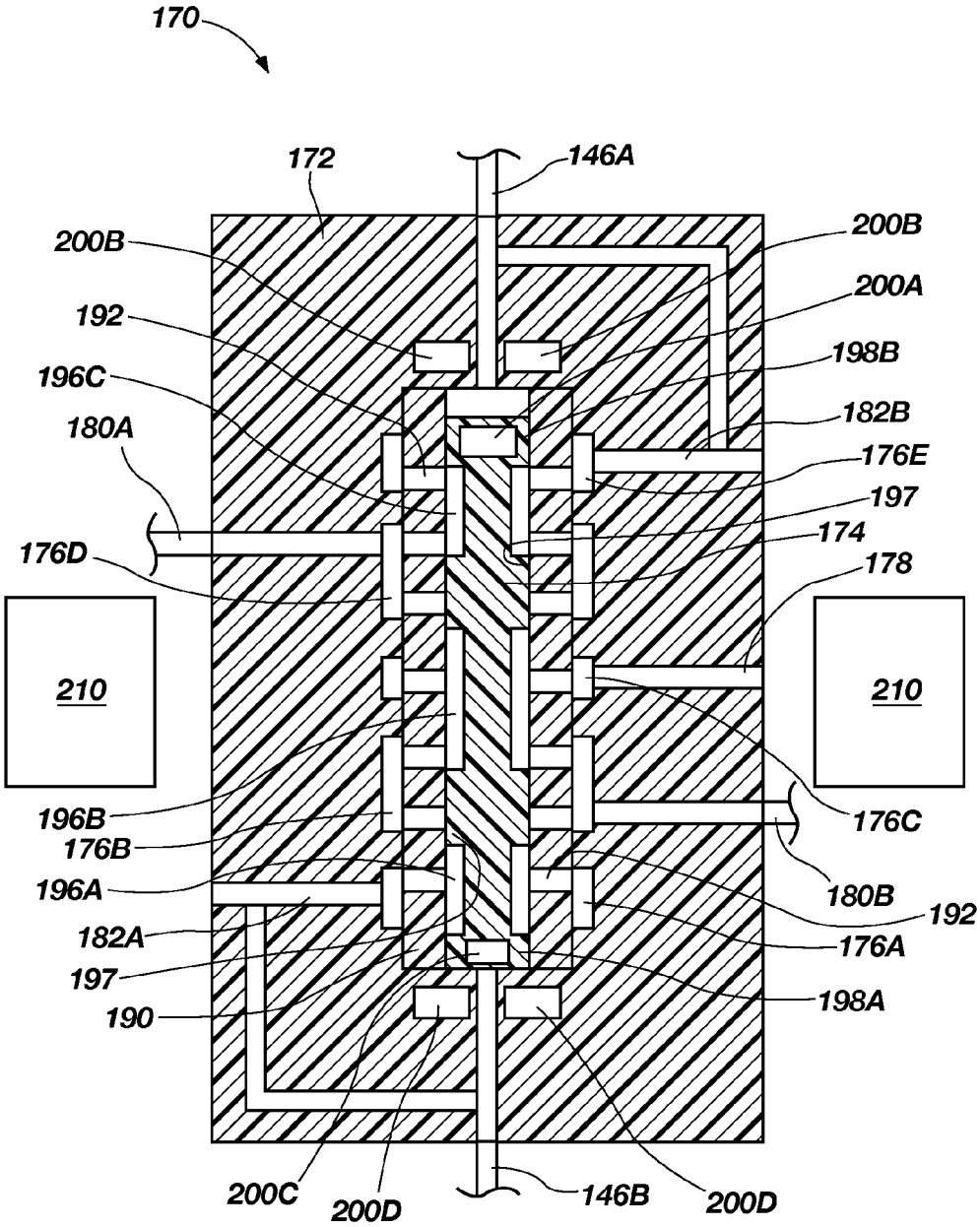
FIG. 5 is an enlarged view of another portion of FIG. 2 illustrating the shuttle valve.

FIG. 5 is an enlarged view of a portion of FIG. 2 including the shuttle valve 170. As shown in FIG. 5, the shuttle valve 170 includes a shuttle valve body 172, and a shuttle spool 174 disposed within a bore extending at least partially through the shuttle valve body 172. Five recesses 176A-176E may be provided in a wall of the shuttle valve body 172 within the bore in which the shuttle spool 174 is located. Each of the five recesses 172A-172E may comprise a substantially continuous annular recess that extends around the bore in the shuttle valve body 172 in which the shuttle spool 174 is disposed. Thus, each of the five recesses 176A-176E can be seen in the cross-sectional view of FIG. 4 on the left and right sides of the shuttle spool 174 (from the perspective of FIG. 5). A fluid conduit may lead through the shuttle valve body 172 to each of the five recesses 176A-176E, respectively.

A drive fluid conduit 178 may lead to the middle, third recess 176C, as shown in FIG. 5. Thus, a pressurized drive fluid may be supplied to the third recess 176C from a pressurized source of drive fluid (e.g., a source of compressed gas, such as compressed air).

As can be seen by viewing FIGS. 2 and 5 together, the first drive chamber conduit 180A may extend between the fourth recess 176D and the first drive fluid chamber 127, and a second drive chamber conduit 180B may extend between the second recess 176B and the second drive fluid chamber 129.

A first shuttle valve vent conduit 182A may extend from the first recess 176A to the exterior of the shuttle valve body 172, and a second shuttle valve vent conduit 182B may extend from the fifth recess 176E to the exterior of the shuttle valve body 172. Mufflers or other fluid conduits optionally may be coupled to the shuttle valve vent conduits 182A, 182B to vent the drive fluid to a desirable container or location.

The first shift-shuttle conduit 146A (previously described with reference to FIGS. 2 and 4) may extend between the first recess 143A adjacent the first shift piston 140 (FIG. 4) and a first longitudinal end of the bore in the shuttle valve body 172 in which the shuttle spool 174 is disposed, and the second shift-shuttle conduit 146B may extend between a similar recess adjacent the second shift piston 142 (FIG. 2) and an opposite, second longitudinal end of the bore in the shuttle valve body 172 in which the shuttle spool 174 is disposed.

As shown in FIG. 5, a cylindrical insert 190 may be disposed between the shuttle spool 174 and the five recesses 176A-176E in the wall of the shuttle valve body 172 within the bore in which the shuttle spool 174 is disposed. The cylindrical insert 190 may comprise one or more holes 192 that extend through the cylindrical insert 190 in planes transverse to the longitudinal axis of the shuttle spool 174 that are aligned with the five recesses 176A-176E. Thus, fluid communication is provided between the interior of the cylindrical insert 190 and each of the recesses 176A-176E through the holes 192 in the cylindrical insert 190. Furthermore, a plurality of annular sealing members (e.g., O-rings) (not shown) optionally may be provided between the outer cylindrical surface of the cylindrical insert 190 and the adjacent wall of the of the shuttle valve body 172 within the bore in which the cylindrical insert 190 is disposed to eliminate fluid communication between any of the recesses 176A-176E through any space between the cylindrical insert 190 and the shuttle valve body 172.

The shuttle spool 174 comprises a first annular recess 196A, a second annular recess 196B, and a third annular recess 196C in the outer surface of the shuttle spool 174. The first annular recess 196A, the second annular recess 196B, and the third annular recess 196C are separated from one another by annular ridges 197 in the outer surface of the shuttle spool 174. Furthermore, an annular first end ridge 198A is provided in the outer surface of the shuttle spool 174 on a longitudinal side of the first annular recess 196A opposite the annular ridge 197 proximate thereto, and an annular second end ridge 198B is provided in the outer surface of the shuttle spool 174 on a longitudinal side of the third annular recess 196C opposite the central annular ridge 197 proximate thereto.

Each of the first annular recess 196A, the second annular recess 196B, and the third annular recess 196C have a length (i.e., a dimension generally parallel to the longitudinal axis of the shuttle spool 174) that is long enough to at least partially longitudinally overlap two adjacent recesses of the five recesses 176A-176E at least in one position of the shuttle spool 174. For example, when the shuttle spool 174 is in the position shown in FIG. 5, the first annular recess 196A extends to and at least partially overlaps with only the first recess 176A, the second annular recess 196B extends to and at least partially overlaps with the second recess 176B and the third recess 176C, and the third annular recess 196C extends to and at least partially overlaps with each of the fourth recess 176D and the fifth recess 176E. In this configuration, fluid communication is provided between the drive fluid conduit 178 and the second drive chamber conduit 180B through the third recess 176C, the holes 192 in the cylindrical insert 190 aligned with the third recess 176C, the second annular recess 196B in the shuttle spool 174, the holes 192 in the cylindrical insert 190 aligned with the second recess 176B, and the second recess 176B. Also in this configuration, fluid communication is provided between the first drive chamber conduit 180A and the second shuttle valve vent conduit 182B through the fourth recess 176D, the holes 192 in the cylindrical insert 190 aligned with the fourth recess 176D, the third annular recess 196C in the shuttle spool 174, the holes 192 in the cylindrical insert 190 aligned with the fifth recess 176E, and the fifth recess 176E.

As can be seen by viewing FIGS. 2, 4, and 5 together, the shuttle spool 174 may be moved to the position shown in FIG. 5 by applying a pressurized drive fluid through the shuttle valve 170 from the drive fluid conduit 178 to the first drive chamber conduit 180A, through the first drive fluid chamber 127, and through the first shift-shuttle conduit 146A to the second end of the shuttle spool 174. Thus, in some embodiments, the shuttle spool 174 is moved back and forth within the shuttle valve body 172 by applying positive pressure to one longitudinal end surface of the shuttle spool 174 while ambient (atmospheric) pressure is provided to the opposite longitudinal end surface of the shuttle spool 174. As the shuttle spool 174 moves to the position shown in FIG. 5, any fluid (e.g., a gas, such as air) adjacent the first end of the shuttle spool 174 and within the second shift-shuttle conduit 146B may be vented to ambient through the first shuttle valve vent conduit 182A. The shuttle spool 174 may be maintained in the position shown in FIG. 5 by maintaining the positive pressure at the second end of the shuttle spool 174 (and within the first shift-shuttle conduit 146A), and/or by using one or more detent mechanisms.

In accordance with some embodiments of the invention, the shuttle valve 170 may include at least one magnet carried by the shuttle spool 174. The at least one magnet may be located, oriented, and configured to impart a force on the shuttle spool 174 responsive to a proximate magnetic field in a manner similar to that described above in relation to the magnets 138A, 138B, 138C and the plungers 120, 122.

For example, as shown in FIG. 5, the shuttle valve 170 may include a first magnet 200A that is carried by the shuttle spool 174. In some embodiments, the first magnet 200A may be located proximate an end of the shuttle spool 174 as shown in FIG. 5, although in other embodiments, the first magnet 200A may be located anywhere along a length of the shuttle spool 174.

The shuttle valve 170 may include at least one additional magnet that is located, oriented, and configured to provide a proximate magnetic field in a region encompassing the first magnet 200A. For example, a second magnet 200B may be located within the shuttle valve body 172 of the shuttle valve 170. The second magnet 200B may be located proximate an end of the shuttle valve body 172 corresponding to the end of the shuttle spool 174 in which the first magnet 200A is disposed, as shown in FIG. 5.

A third magnet 200C optionally provided at an opposite end of the shuttle spool 174 from the first magnet 200A, and a fourth magnet 200D optionally may be located within the shuttle valve body 172 of the shuttle valve 170 proximate an end of the shuttle valve body 172 corresponding to the end of the shuttle spool 174 in which the third magnet 200C is disposed, as shown in FIG. 5.

Each of the magnets 200A-200D may comprise, for example, a permanent magnet at least substantially comprised of a magnetic material. The magnetic material may comprise, for example, a rare earth element (i.e., each of the magnets 200A-200D may comprise a permanent rare earth magnet). As non-limiting examples, the magnetic material may comprise at least one of a samarium cobalt alloy and a neodymium iron alloy. In some embodiments, each of the magnets 200A-200D may comprise an electromagnetic device. In some embodiments, the shuttle valve body 172 and the shuttle spool 174, with the exception of the magnets 200A-200D, may be at least substantially comprised of a non-magnetic material such as a polymer and/or a non-magnetic metal. By way of example and not limitation, such a polymer may comprise one or more of a fluoropolymer, neoprene, buna-N, ethylene diene M-class (EPDM), VITON®, polyurethane, HYTREL®, SANTOPRENE®, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), NORDEL™, and nitrile. By way of example and not limitation, such a non-magnetic metal may comprise one or more of a stainless steel, INCONEL®, MONEL®, HASTELLOY®, a high nickel alloy, brass, copper, bronze, aluminum, and zinc.

The magnets 200A-200D may be located, oriented, and configured to impart a force on the shuttle spool 174 as the shuttle spool 174 moves back and forth within the shuttle valve body 172. For example, the first magnet 200A and the third magnet 200C may be located, oriented, and configured to bias the shuttle spool 174 to at least one position within the shuttle valve body 172 responsive to the proximate magnetic fields provided by the second magnet 200B and the fourth magnet 200D.

For example, the first magnet 200A carried by the shuttle spool 174 may be located, oriented, and configured to impart a force on the shuttle spool 174 responsive to a proximate magnetic field provided by the second magnet 200B within the shuttle valve body 172 when the shuttle spool 174 slides back and forth within the shuttle valve body 172. For example, the first magnet 200A carried by the shuttle spool 174 and the second magnet 200B disposed within the shuttle valve body 172 may be located along and centered about a common axis along which the shuttle spool 174 slides during operation thereof, and may be oriented such that the polarity of the first magnet 200A is opposite the polarity of the second magnet 200B. In other words, the magnetic moment vector of the first magnet 200A may extend in a direction opposite to the magnetic moment vector of the second magnet 200B. Further, the magnetic moment vector of the first magnet 200A may be parallel to and aligned along a common axis (e.g., the axis along which the shuttle spool 174 slides) with the magnetic moment vector of the second magnet 200B. In this configuration, a repulsive force will be applied between the first magnet 200A and the second magnet 200B, the magnitude of which will increase as the first magnet 200A and the second magnet 200B are brought into proximity with one another during operation of the shuttle valve 170. The second magnet 200B may be disposed in a fixed location within the shuttle valve body 172 such that the second magnet 200B does not move during operation of the shuttle valve 170. Thus, as the first magnet 200A is carried by the shuttle spool 174, the force applied to the first magnet 200A by the proximate magnetic field of the second magnet 200B will be translated and applied to the shuttle spool 174. As a result, a force will be applied to the shuttle spool 174 by the proximate magnetic field of the second magnet 200B that urges the shuttle spool 174 to slide toward the position shown in FIG. 5.

Similarly, the third magnet 200C carried by the shuttle spool 174 may be located, oriented, and configured to impart a force on the shuttle spool 174 responsive to a proximate magnetic field provided by the fourth magnet 200D within the shuttle valve body 172 when the shuttle spool 174 slides back and forth within the shuttle valve body 172. For example, the third magnet 200C carried by the shuttle spool 174 and the fourth magnet 200D disposed within the shuttle valve body 172 may be located along and centered about a common axis along which the shuttle spool 174 expands and compresses, and may be oriented such that the polarity of the third magnet 200C is the same as the polarity of the fourth magnet 200D. In other words, the magnetic moment vector of the third magnet 200C may extend in the same direction in which the magnetic moment vector of the fourth magnet 200D extends. Further, the magnetic moment vector of the third magnet 200C may be parallel to and aligned along a common axis (e.g., the axis along which the shuttle spool 174 slides) with the magnetic moment vector of the fourth magnet 200D. In this configuration, an attractive force will be applied between the third magnet 200C and the fourth magnet 200D, the magnitude of which will increase as the third magnet 200C and the fourth magnet 200D are brought into proximity with one another during operation of the shuttle valve 170. The fourth magnet 400D may be disposed in a fixed location within the shuttle valve body 172 such that the fourth magnet 200D does not move during operation of the shuttle valve 170. Thus, as the third magnet 200C is carried by the shuttle spool 174, the force applied to the third magnet 200C by the proximate magnetic field of the fourth magnet 200D will be translated and applied to the shuttle spool 174. As a result, a force will be applied to the shuttle spool 174 by the proximate magnetic field of the fourth magnet 200D that further urges the shuttle spool 174 to slide toward the position shown in FIG. 5.

The magnets 200A-200D may be configured such that the force acting on the shuttle spool 174 by the magnets 200A-

200D is sufficient to cause the shuttle spool 174 to slide to the position shown in FIG. 5 in the absence of pressurization of the second shift-shuttle conduit 146B, but not so high as to prevent the shuttle spool 174 from sliding upward (from the perspective of FIG. 5) against the forces of the magnets 200A-200D when the second shift-shuttle conduit 146B is pressurized with drive fluid, as described herein.

In additional embodiments, the proximate magnetic field used to apply a force to magnets carried by the shuttle spool 174 (e.g., the first magnet 200A and the third magnet 200C) may be at least partially provided by one or more magnets positioned outside the shuttle valve body 172. For example, as shown in FIG. 5, a magnet 210 may be provided outside the shuttle valve body 172 and used to generate a proximate magnetic field in a region encompassing at least one magnet carried by the shuttle spool 174, such as the first magnet 200A and the third magnet 200C. The magnet 210 may be used instead of, or in addition to, any magnets within the shuttle valve body 172 that are used to generate the proximate magnetic field used to apply a force to the magnets carried by the shuttle spool 174. In some embodiments, the magnet 210 may comprise an electromagnetic device such as an electrical coil (i.e., a conductive line or wire wrapped in a coil). The electrical coil may encircle at least a portion of the shuttle valve body 172, as shown in FIG. 5. In additional embodiments, the magnet 210 may comprise one or more permanent magnets located outside the shuttle valve body 172 that are located, oriented, and configured to generate a desirable electrical field for applying a force to the magnets carried by the shuttle spool 174 (e.g., the first magnet 200A and the third magnet 200C).

Shuttle valves like that shown in FIG. 5 may be susceptible to stalling when the shuttle spool 174 stops unintentionally at an intermediate position between the two operational positions thereof (at the longitudinal ends of the bore within the shuttle valve body 172), such that drive fluid is either precluded from passing from the drive fluid conduit 178 through the shuttle valve body 172 to either of the first and second drive chamber conduits 180A, 180B, or such that drive fluid flows from the drive fluid conduit 178 through the shuttle valve body 172 to each of the first and second drive chamber conduits 180A, 180B in an at least substantially equal manner. By using one or more magnets, such as the magnets 200A-200D, to bias the shuttle spool 174 toward one of the two operational positions of the shuttle spool 174, occurrences of such stalling may be reduced or at least substantially eliminated.

To facilitate a complete understanding of operation of the reciprocating fluid pump 100, a complete pumping cycle of the reciprocating fluid pump 100 (including a leftward stroke and a rightward stroke of each of the plungers 120, 122) is described below.

A cycle of the reciprocating fluid pump 100 may begin while the shuttle spool 174 of the shuttle valve 170 is in the position shown in FIGS. 2 and 5. As previously described, upon movement of the shuttle spool 174 into the position shown in FIGS. 2 and 5, pressurized drive fluid passes from the drive fluid conduit 178 (FIGS. 2 and 5), around the shuttle spool 174 within the second annular recess 196B therein and into the second drive chamber conduit 180B. The pressurized drive fluid flows through the second drive chamber conduit 180B to the second drive fluid chamber 129 (FIG. 2), which urges the second plunger 122 to the left (from the perspective of FIG. 2). As the second plunger 122 moves to the left, the first drive fluid chamber 127 is depressurized (e.g., vented to ambient, a reduced pressure, or even a vacuum) and, as a result, the first magnet 138A and the first plunger 120 are pushed to the left, responsive to the proximate magnetic field provided by the third magnet 138C disposed within the pump body 102. As the first plunger 120 and the second plunger 122 move to the left (from the perspective of FIG. 2), subject fluid within the second subject fluid chamber 128 is forced out from the second subject fluid chamber 128 through the second subject fluid outlet 136 leading out from the second subject fluid chamber 128, and subject fluid is drawn into the first subject fluid chamber 126 through the first subject fluid inlet 130 leading to the first subject fluid chamber 126.

As this leftward stroke continues, the second shift piston 142 is urged to the left by the pressurized drive fluid within the space 162 (FIG. 2), and the first shift piston 140 is urged to the left by the first plunger 120. This leftward stoke continues until the second shift piston 142 is moved far enough to the left to allow pressurized drive fluid within the space 162 to pass into the second shift-shuttle conduit 146B. When the pressurized drive fluid enters the second shift-shuttle conduit 146B, a pulse of pressurized drive fluid flows through the second shift-shuttle conduit 146B to the first end of the shuttle spool 174 within the shuttle valve 170, which will cause the shuttle spool 174 to slide within the shuttle valve body 172 (i.e., toward the top of the shuttle valve 170 from the perspective of FIGS. 2 and 5).

Although the shuttle spool 174 is not illustrated in the drawing Figures as being positioned at the opposite end of the bore within the shuttle valve body 172, it will be appreciated that, when the shuttle spool 174 is moved to the opposite end of the bore within the shuttle valve body 172, the pressurized drive fluid entering the shuttle valve 170 through the drive fluid conduit 178 will be diverted from the second drive chamber conduit 180B to the first drive chamber conduit 180A. In other words, upon movement of the shuttle spool 174 to the opposite end of the shuttle valve body 172, pressurized drive fluid will pass from the drive fluid conduit 178, through the second annular recess 196B in the shuttle spool 174, and through the first drive chamber conduit 180A to the first drive fluid chamber 127 (FIG. 2), which will urge the first plunger 120 to the right (from the perspective of FIG. 2). As the first plunger 120 moves to the right, the second drive fluid chamber 129 is depressurized (e.g., vented to ambient, a reduced pressure, or even a vacuum) and, as a result, the second magnet 138B and the second plunger 122 are pushed to the right responsive to the proximate magnetic field provided by the third magnet 138C disposed within the pump body 102. As the first plunger 120 and the second plunger 122 move to the right (from the perspective of FIG. 2), subject fluid within the first subject fluid chamber 126 is forced out from the first subject fluid chamber 126 through the first subject fluid outlet 134 leading out from the first subject fluid chamber 126, and subject fluid is drawn into the second subject fluid chamber 128 through the respective second subject fluid inlet 132 leading to the second subject fluid chamber 128.

This rightward stoke continues until the first shift piston 140 moves sufficiently far to the right (from the perspectives of FIGS. 2 and 4) to allow the pressurized drive fluid within the first drive fluid chamber 127 to enter into the first shift-shuttle conduit 146A, which will cause the shuttle spool 174 to return to the position shown in FIGS. 2 and 5, thereby completing one full cycle of the reciprocating fluid pump 100, at which point, a new cycle begins This reciprocating action may be continued, which results in at least substantially continuous flow of subject fluid through the reciprocating fluid pump 100.

The shuttle valve 170 of FIGS. 2 and 5 may be referred to as a pneumatic switch for changing the direction of movement of the first and second shift pistons 140, 142 of the reciprocating fluid pump 100 in the reciprocating action. In additional embodiments, a mechanical, electrical, or other pneumatic switch (not shown) may be used in addition to or in place of the shuttle valve 170 for changing the direction of movement of the first and second shift pistons 140, 142. For example, a proximity switch (e.g., a mechanical switch, an optical switch, a fiber optic switch) may sense the location of the first shift piston 140 and signal a shifting mechanism to change the direction of movement of the first shift piston 140 in the reciprocating action.

Although the reciprocating fluid pump 100 of FIGS. 1, 2, 4, and 5 includes three magnets 138A, 138B, 138C used for applying forces to the first plunger 120 and the second plunger 122 during operation thereof, additional embodiments of the invention may include less than three such magnets, or more than three such magnets.

Figure 6:
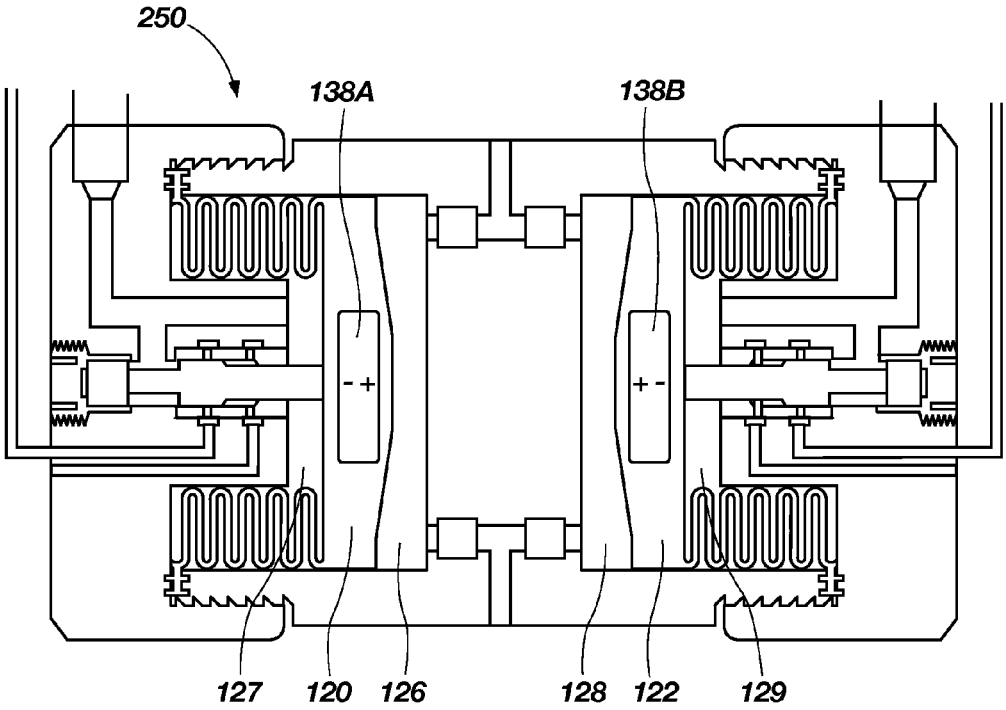
FIG. 6 is a schematically illustrated cross-sectional view of another example embodiment of a reciprocating fluid pump of the invention.

FIG. 6 illustrates another embodiment of a reciprocating fluid pump 250 that is at least substantially similar to the reciprocating fluid pump 100, except that the reciprocating fluid pump 250 only includes a first magnet 138A carried by the first plunger 120 and a second magnet 138B carried by the second plunger 122, but does not include any additional magnet within the pump body 102, such as the third magnet 138C shown in FIG. 2. In this embodiment, the first magnet 138A and the second magnet 138B are located, oriented, and configured to cause a repulsive force between the first magnet 138A and the second magnet 138B when the plungers 120, 122 expand and compress in the reciprocating action within the pump body 102 responsive to the proximate magnetic fields provided by each of the first magnet 138A and the second magnet 138B.

In the embodiment of FIG. 6, the first magnet 138A carried by the first plunger 120 may be located and oriented to impart a force on the first plunger 120 responsive to a proximate magnetic field provided by the second magnet 138B carried by the second plunger 122, and the second magnet 138B carried by the second plunger 122 may be located and oriented to impart a force on the second plunger 122 responsive to a proximate magnetic field provided by the first magnet 138A carried by the first plunger 120. The first magnet 138A carried by the first plunger 120 and the second magnet 138B carried by the second plunger 122 may be located along and centered about a common axis along which the first plunger 120 and the second plunger 122 expand and compress, and may be oriented such that the polarity of the first magnet 138A is opposite the polarity of the second magnet 138B. In other words, the magnetic moment vector of the first magnet 138A may extend in a direction opposite to the magnetic moment vector of the second magnet 138B. Further, the magnetic moment vector of the first magnet 138A may be parallel to and aligned along a common axis (e.g., the axis along which the first plunger 120 and the second plunger 122 expand and compress) with the magnetic moment vector of the second magnet 138B. In this configuration, a repulsive force will be applied between the first magnet 138A and the second magnet 138B, the magnitude of which will increase as the first magnet 138A and the second magnet 138B are brought into proximity with one another during operation of the reciprocating fluid pump 250.

The first magnet 138A and the second magnet 138B may be configured such that the force acting on the first plunger 120 by the first magnet 138A and the second magnet 138B is sufficient to cause the first plunger 120 to compress in the absence of pressurization of the first drive fluid chamber 127 as described herein, but not so high as to prevent extension of the first plunger 120 when the first drive fluid chamber 127 is pressurized with drive fluid, as described herein. Similarly, the first magnet 138A and the second magnet 138B may be configured such that the force acting on the second plunger 122 by the first magnet 138A and the second magnet 138B is sufficient to cause the second plunger 122 to compress in the absence of pressurization of the second drive fluid chamber 129 as described herein, but not so high as to prevent extension of the second plunger 122 when the second drive fluid chamber 129 is pressurized with drive fluid, as described herein.

Figure 7:
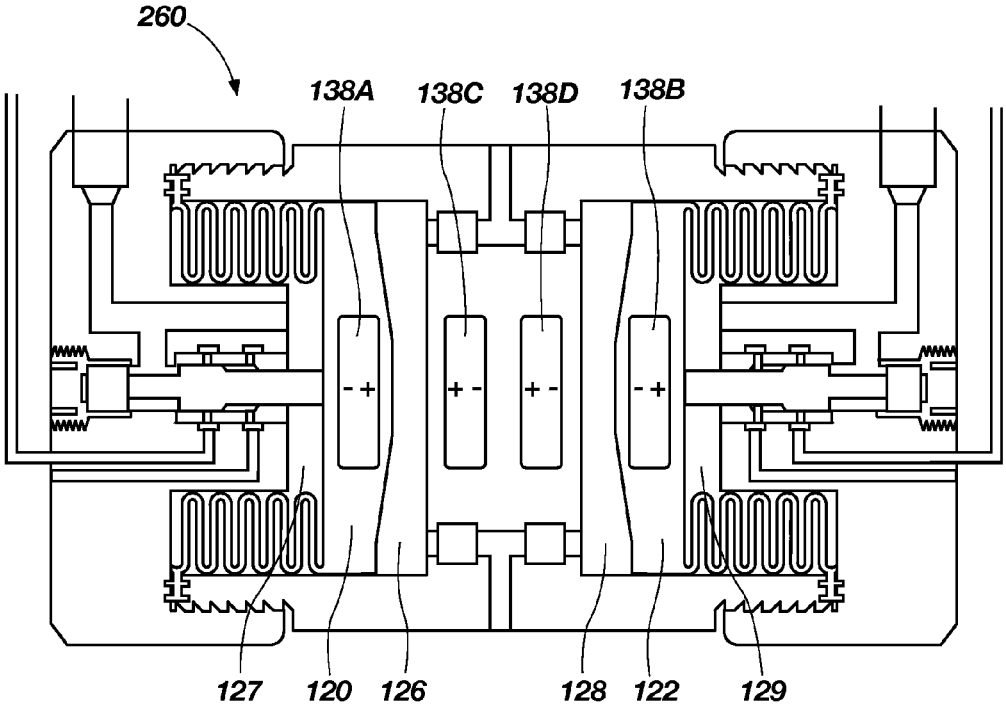
FIG. 7 is a schematically illustrated cross-sectional view of another example embodiment of a reciprocating fluid pump of the invention.

FIG. 7 illustrates another embodiment of a reciprocating fluid pump 260 that is at least substantially similar to the reciprocating fluid pump 100, except that the reciprocating fluid pump 260 includes a first magnet 138A carried by the first plunger 120, a second magnet 138B carried by the second plunger 122, a third magnet 138C disposed within the central body 104 of the pump body 102 between the plungers 120, 122 and proximate the first plunger 120, and a fourth magnet 138D disposed within the central body 104 of the pump body 102 between the plungers 120, 122 and proximate the second plunger 122. The third magnet 138C and the fourth magnet 138D may be disposed at a fixed location within the central body 104 of the pump body 102 between the plungers 120, 122, such that they do not move relative to the pump body 102 during operation of the reciprocating fluid pump 100. Each of the third magnet 138C and the fourth magnet 138D may be a permanent magnet or an electromagnetic device.

In this embodiment, the first magnet 138A and the third magnet 138C are located, oriented, and configured to cause a repulsive force between the first magnet 138A and the third magnet 138C when the first plunger 120 expands and compresses in the reciprocating action within the pump body 102 responsive to the proximate magnetic fields provided by each of the first magnet 138A and the third magnet 138C. Similarly, the second magnet 138B and the fourth magnet 138D are located, oriented, and configured to cause a repulsive force between the second magnet 138B and the fourth magnet 138D when the second plunger 122 expands and compresses in the reciprocating action within the pump body 102, responsive to the proximate magnetic fields provided by each of the second magnet 138B and the fourth magnet 138D. The first magnet 138A and the third magnet 138C may be configured such that the force acting on the first plunger 120 by the first magnet 138A and the second magnet 138B is sufficient to cause the first plunger 120 to compress in the absence of pressurization of the first drive fluid chamber 127 as described herein, but not so high as to prevent extension of the first plunger 120 when the first drive fluid chamber 127 is pressurized with drive fluid, as described herein. Similarly, the second magnet 138B and the fourth magnet 138D may be configured such that the force acting on the second plunger 122 by the second magnet 138B and the fourth magnet 138D is sufficient to cause the second plunger 122 to compress in the absence of pressurization of the second drive fluid chamber 129 as described herein, but not so high as to prevent extension of the second plunger 122 when the second drive fluid chamber 129 is pressurized with drive fluid, as described herein.

Although the third magnet 138C and the fourth magnet 138D have been shown and described as magnets (e.g., permanent magnets, electromagnetic devices), other configurations are also contemplated by the present disclosure. For example, in some embodiments, a magnetic material (e.g., a ferrous material) may be used in place of or in addition to at least one of the third magnet 138C and the fourth magnet 138D.

Figure 8:
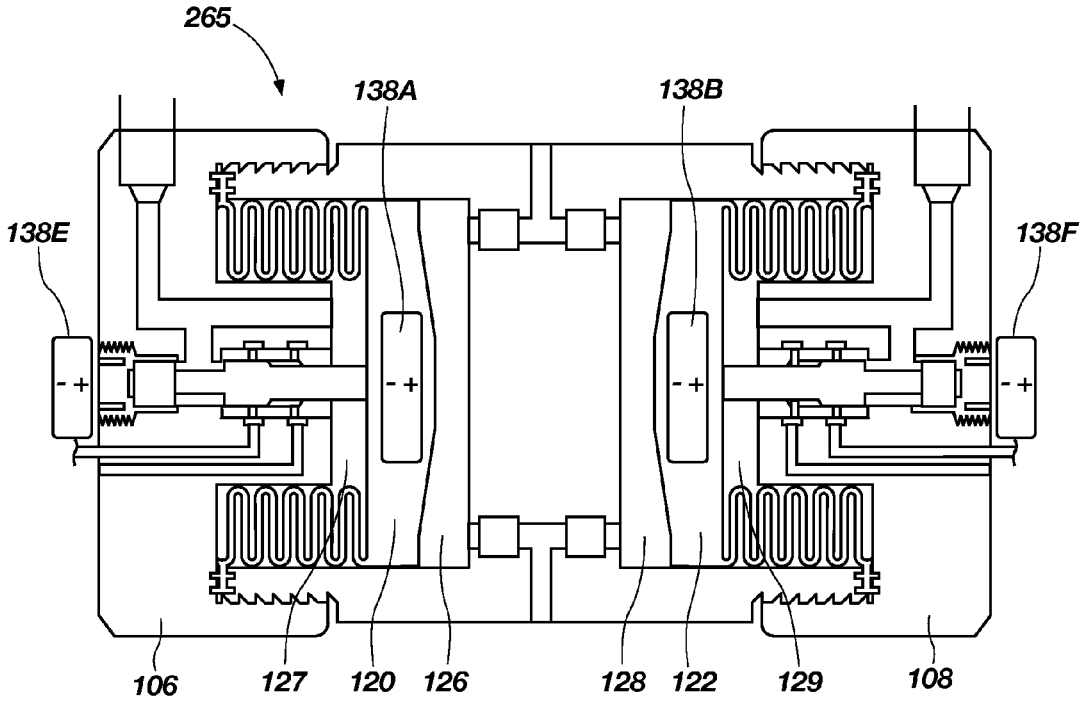
FIG. 8 is a schematically illustrated cross-sectional view of another example embodiment of a reciprocating fluid pump of the invention.

FIG. 8 illustrates another embodiment of a reciprocating fluid pump 265 that is at least substantially similar to the reciprocating fluid pump 100, except that the reciprocating fluid pump 265 includes a first magnet 138A carried by the first plunger 120, a second magnet 138B carried by the second plunger 122, a fifth magnet 138E disposed outside the pump body 102 proximate the first end piece 106, and a sixth magnet 138F disposed outside the pump body 102 proximate the second end piece 108. The fifth magnet 138E and the sixth magnet 138F may be disposed at a fixed location outside pump body 102 and may be located along and centered about a common axis along which the first and second plungers 120, 122 expand and compress, such that they do not move relative to the pump body 102 during operation of the reciprocating fluid pump 100. Each of the fifth magnet 138E and the sixth magnet 138F may be a permanent magnet or an electromagnetic device.

In this embodiment, the first magnet 138A and the fifth magnet 138E are located, oriented, and configured to cause an attractive force between the first magnet 138A and the fifth magnet 138E when the first plunger 120 expands and compresses in the reciprocating action within the pump body 102 responsive to the proximate magnetic fields provided by each of the first magnet 138A and the fifth magnet 138E. Similarly, the second magnet 138B and the sixth magnet 138F are located, oriented, and configured to cause an attractive force between the second magnet 138B and the sixth magnet 138F when the second plunger 122 expands and compresses in the reciprocating action within the pump body 102, responsive to the proximate magnetic fields provided by each of the second magnet 138B and the sixth magnet 138F. The first magnet 138A and the fifth magnet 138E may be configured such that the force acting on the first plunger 120 by the first magnet 138A and the second magnet 138B is sufficient to cause the first plunger 120 to compress in the absence of pressurization of the first drive fluid chamber 127 as described herein, but not so high as to prevent extension of the first plunger 120 when the first drive fluid chamber 127 is pressurized with drive fluid, as described herein. Similarly, the second magnet 138B and the sixth magnet 138F may be configured such that the force acting on the second plunger 122 by the second magnet 138B and the sixth magnet 138F is sufficient to cause the second plunger 122 to compress in the absence of pressurization of the second drive fluid chamber 129 as described herein, but not so high as to prevent extension of the second plunger 122 when the second drive fluid chamber 129 is pressurized with drive fluid, as described herein. The first magnet 138A and the second magnet 138B may be located, oriented, and configured to cause a repulsive force between the first magnet 138A and the second magnet 138B when the plungers 120, 122 expand and compress in the reciprocating action within the pump body 102 responsive to the proximate magnetic fields provided by each of the first magnet 138A and the second magnet 138B.

Although the fifth magnet 138E and the sixth magnet 138F have been shown and described as magnets (e.g., permanent magnets, electromagnetic devices), other configurations are also contemplated by the present disclosure. For example, in some embodiments, a magnetic material (e.g., a ferrous material) may be used in place of or in addition to at least one of the fifth magnet 138E and the sixth magnet 138F.

Figure 9:
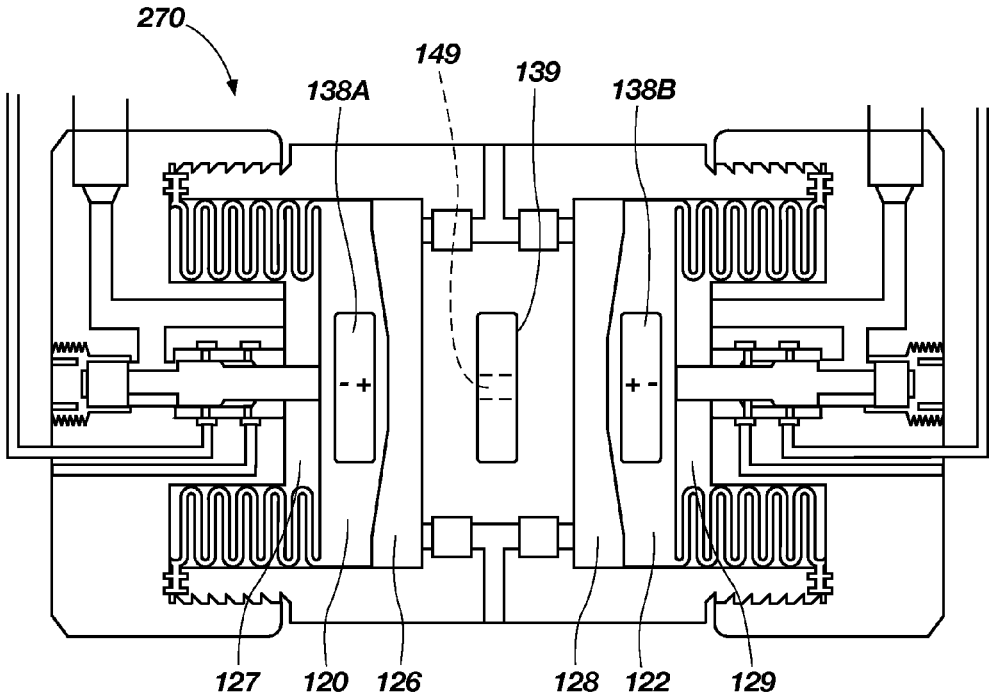
FIG. 9 is a schematically illustrated cross-sectional view of another example embodiment of a reciprocating fluid pump of the invention.

FIG. 9 illustrates another embodiment of a reciprocating fluid pump 270 that is at least substantially similar to the reciprocating fluid pump 100, except that the reciprocating fluid pump 270 includes a first magnet 138A carried by the first plunger 120, a second magnet 138B carried by the second plunger 122, and a magnetic field baffle 139 disposed within the central body 104 of the pump body 102 between the plungers 120, 122. The magnetic field baffle 139 may be disposed at a fixed location within the central body 104 of the pump body 102 between the plungers 120, 122, such that it does not move relative to the pump body 102 during operation of the reciprocating fluid pump 100.

In this embodiment, the first magnet 138A and the second magnet 138B are located, oriented, and configured to cause a repulsive force between the first magnet 138A and the second magnet 138B when the plungers 120, 122 expand and compress in the reciprocating action within the pump body 102 responsive to the proximate magnetic fields provided by each of the first magnet 138A and the second magnet 138B. The magnetic field baffle 139 may be configured to alter the magnetic field provided by the first magnet 138A and the second magnet 138B. By way of example, the magnetic field baffle 139 may be formed of a magnetic material, such as a ferrous material. The magnetic field baffle 139 may, by way of example, have a generally circular shape with a hole 149 therethrough (i.e., a donut shape).

In the embodiment of FIG. 9, the reciprocating fluid pump 270 may function similarly to the reciprocating fluid pump 250 of FIG. 6, as described above. For example, the first magnet 138A carried by the first plunger 120 may be located and oriented to impart a force on the first plunger 120 responsive to a proximate magnetic field provided by the second magnet 138B carried by the second plunger 122, and the second magnet 138B carried by the second plunger 122 may be located and oriented to impart a force on the second plunger 122 responsive to a proximate magnetic field provided by the first magnet 138A carried by the first plunger 120.

However, the presence of the magnetic field baffle 139 in the reciprocating fluid pump 270 of the embodiment of FIG. 9 may alter the magnetic field provided by the first magnet 138A and the second magnet 138B and change the magnitude of the force imparted between the first magnet 138A and the second magnet 138B. For example, the first magnet 138A and the second magnet 138B may be located a distance apart from each other and experience a magnetic force based on that distance. As the distance between the first magnet 138A and the second magnet 138B increases, the force may decrease. The presence of the magnetic field baffle 139 may alter the magnetic field such that the magnetic force may decrease more quickly with the increased distance relative to a configuration without the magnetic field baffle 139 (e.g., FIG. 6). The magnetic field baffle 139 of the reciprocating fluid pump 270 may enable the first plunger 120 and the second plunger 122 to expand and compress with a reduced force imparted by the first magnet 138A and the second magnet 138B when they are relatively more distant from each other. However, the magnetic field baffle 139 may still allow the second magnet 138B to impart a sufficient force on the first magnet 138A to cause the first plunger 120 to compress in the absence of pressurization of the first drive fluid chamber 127 when the first magnet 138A and the second magnet 138B are more proximate each other, as described above. Therefore, the magnetic field baffle 139 may improve the efficiency of the reciprocating fluid pump 270 by reducing the force against which the reciprocating action of the first plunger 120 and the second plunger 122 may act in normal operation.

Figure 10:
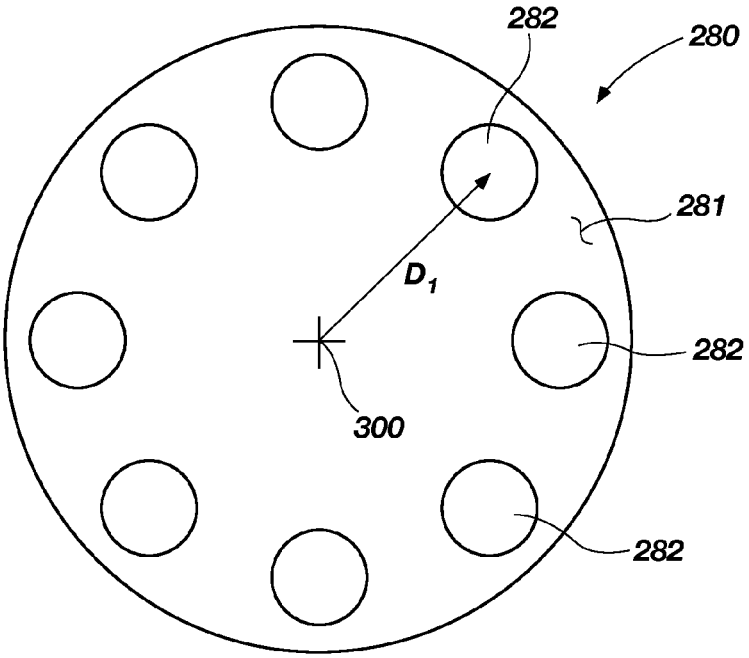
FIGS. 10 and 11 are simplified, schematically illustrated cross-sectional views of plungers, each of which carries a plurality of magnets, which may be used in additional embodiments of reciprocating fluid pumps of the invention.
Figure 11:
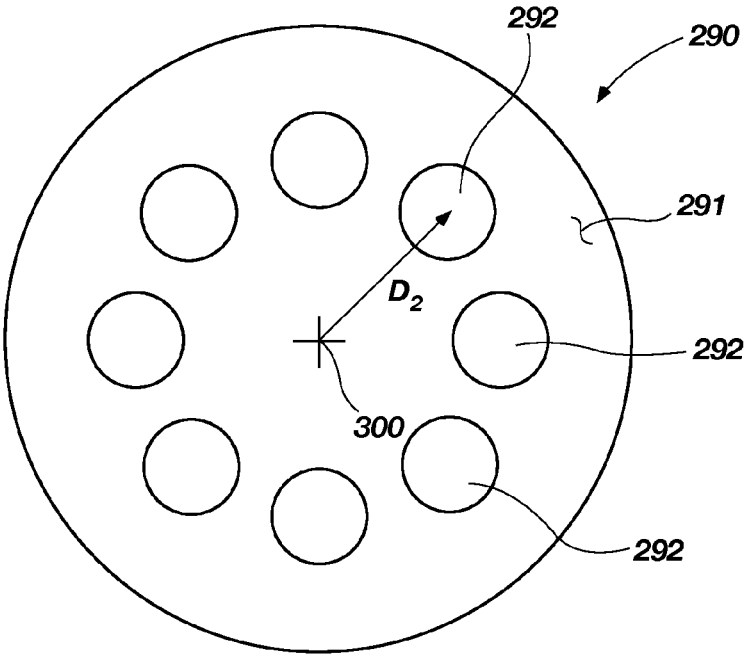

As previously mentioned, in some embodiments of the invention, the plungers 120, 122 may carry more than one magnet. FIG. 10 is a simplified transverse cross-sectional view of an end wall 281 of a first plunger 280 that includes a first set of magnets 282, and FIG. 11 is a simplified transverse cross-sectional view of an end wall 291 of a second plunger 290 that includes a second set of magnets 292. The first plunger 280 and the second plunger 290 may be at least substantially similar to the previously described first plunger 120 and the second plunger 122, and may be used together in a pump such as the reciprocating fluid pump 100 previously described in relation to FIGS. 1, 2, 4, and 5. Each magnet of the first set of magnets 282 and the second set of magnets 292 may be at least substantially similar to the magnets 138A, 138B, 138C previously described with reference to FIG. 2.

The first set of magnets 282 and the second set of magnets 292 may be located, oriented, and configured such that the net proximate magnetic field provided by the first set of magnets 282 and the net proximate magnetic field provided by the second set of magnets 292 provides a repulsive force between the first set of magnets 282 and the second set of magnets 292, and, hence, between the first plunger 280 and the second plunger 290, in a manner substantially similar to that previously described in relation to the reciprocating fluid pump 250 of FIG. 6.

Additionally, the first set of magnets 282 and the second set of magnets 292 may be located, oriented, and configured respectively on the first plunger 280 and the second plunger 290 to impart radial alignment forces on each of the first plunger 280 and the second plunger 290 that urge the first plunger 280 and the second plunger 290 into alignment along an axis 300 along which the first and second plungers 280, 290 expand and compress in a reciprocating action within the pump body 102 (FIGS. 2 and 4) during operation of the reciprocating fluid pump. In other words, the alignment forces may act on the plungers 280, 290 along directions transverse to the axis 300 along which the first and second plungers 280, 290 expand and compress when the plungers 280, 290 move out of alignment along the axis 300 (i.e., are not centered about the axis 300).

By way of example and not limitation, the first set of magnets 282 may be disposed within the end wall 281 of the first plunger 280 in a predetermined circular pattern as shown in FIG. 9. In other words, the centers of each magnet of the first set of magnets 282 may be located along the circumference of an imaginary circle, the center of which lies along the axis 300. Furthermore, the first set of magnets 282 may be circumferentially separated from one another by substantially equal distances. As shown in FIG. 10, the centers of the magnets of the first set of magnets 282 may be located a first distance $D_1$ from the axis 300. The second set of magnets 292 may be disposed within the end wall 291 of the second plunger 290 in a similar predetermined circular pattern as shown in FIG. 11. In other words, the centers of each magnet of the second set of magnets 292 may be located along the circumference of another imaginary circle, the center of which also lies along the axis 300. The second set of magnets 292 also may be circumferentially separated from one another by substantially equal distances. As shown in FIG. 11, the centers of the magnets of the second set of magnets 292 may be located a second distance $D_2$ from the axis 300 that is different than the first distance $D_1$ of FIG. 10. In some embodiments, the second distance $D_2$ may be smaller than the first distance $D_1$, as shown in FIGS. 10 and 11. In other embodiments, the second distance $D_2$ may be greater than the first distance $D_1$.

In this configuration, should either the first plunger 280 or the second plunger 290 be urged out of alignment along the axis 300 during operation of the reciprocating fluid pump, the net proximate magnetic fields generated by the first set of magnets 282 and the second set of magnets 292 may result in an alignment force acting on that plunger 280, 290 along a direction transverse to the axis 300 that will urge the plunger 280, 290 back into alignment along the axis 300. By configuring the first set of magnets 282 and the second set of magnets 292 to apply such alignment forces to the plungers 280, 290, the plungers 280, 290 may be less likely to move out of alignment from the axis 300, which could result in binding and stalling of the plungers 280, 290 within a pump body.

As described hereinabove, in some embodiments of the invention, the end wall of the tubular bodies of the first plungers are not structurally coupled to the end walls of the tubular bodies of the second plungers by a shaft, rod, or other member, as in many prior art devices. Thus, the shifting of the first and second plungers between expansion and compression may be carried out asynchronously in some embodiments of the invention. In other words, the cycle of the first plungers may operate out of phase with the cycle of the second plungers.

In such embodiments, instead of using the previously described shuttle valve 170 (FIGS. 2 and 5) to cycle pressure drive fluid between the first drive fluid chamber 127 and the second drive fluid chamber 129 (FIG. 2), pressurized drive fluid may be independently supplied to each of the first drive fluid chamber 127 and the second drive fluid chamber 129 using different valves to independently pressurize and vent each of the first drive fluid chamber 127 and the second drive fluid chamber 129. Shift pistons, such as the previously described shift pistons 140, 142, or different types of electrical sensors, mechanical sensors, or electromechanical sensors may be used to independently sense the ends of the expansion and compression strokes of each of the first plunger 120 and the second plunger 122, and to independently signal the respective valves used to independently pressurize and vent the first drive fluid chamber 127 and the second drive fluid chamber 129.

Such operation is further described with reference to FIG. 12, which includes two graphs of pressure as a function of time. The graph shown at the top of FIG. 12 represents the pressure $P_{127}$ of the first drive fluid chamber 127 as a function of time, and the graph shown at the bottom of FIG. 12 represents the pressure $P_{129}$ of the second drive fluid chamber 129 over the same period of time represented in the graph at the top of FIG. 12.

Figure 12:
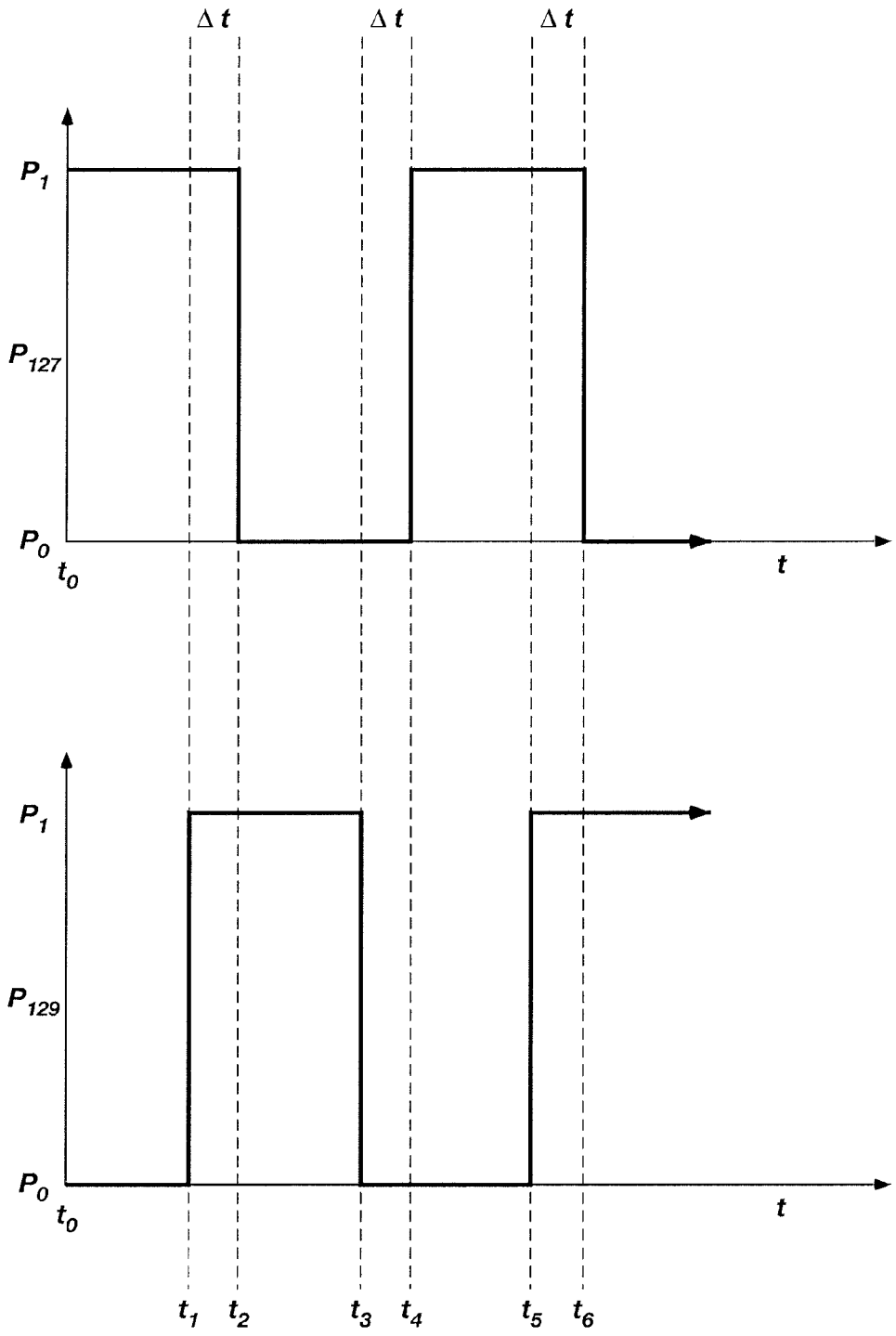
FIG. 12 includes two graphs illustrating examples of methods by which some embodiments of reciprocating fluid pumps of the invention may be cycled in a reciprocating action to pump fluid through the pumps.

As shown in FIG. 12, at time $t_0$, the pressure within the first drive fluid chamber 127 may be at an elevated pressure $P_1$, and the pressure within the second drive fluid chamber 129 may be at a reduced pressure $P_0$ (e.g., atmospheric pressure). At time $t_1$, the second piston 122 (FIG. 2) may reach the end of a compression stroke, and the second drive fluid chamber 129 may be pressurized to the elevated pressure $P_1$. At a later time $t_2$, after a time period $\Delta t$ corresponding to the difference between the phases of the two cycles, the first plunger 120 may reach the end of an extension stroke, and the first drive fluid chamber 127 may be vented to the reduced pressure $P_0$. From time $t_1$ to time $t_2$, both the first drive fluid chamber 127 and the second drive fluid chamber 129 may be at the elevated pressure $P_1$. At time $t_3$, the second drive fluid chamber 129 may be depressurized to the reduced pressure $P_0$. At time $t_4$, the first drive fluid chamber 127 may be pressurized to the elevated pressure $P_1$. From time $t_3$ to time $t_4$, both the first drive fluid chamber 127 and the second drive fluid chamber 129 may be at the reduced pressure $P_0$. At time $t_5$, the second drive fluid chamber 129 may again be pressurized to the elevated pressure $P_1$. The time period extending from time $t_1$ to time $t_5$ represents one complete cycle of the second piston 122. At time $t_6$, the first drive fluid chamber 127 may again be depressurized to the reduced pressure $P_0$. The time period extending from time $t_2$ to time $t_6$ represents one complete cycle of the first piston 120.

In additional embodiments, an electromagnetic device may be used in place of or in addition to one or more of the magnets 138A-138F (FIGS. 2 and 6 through 9), 200A-200D (FIGS. 5), and 210 (FIG. 5), as described above. Such an electromagnetic device may be used to control and/or reduce the movement of the first piston 120 and/or of the second piston 122 in a manner similar to that described above with reference to FIG. 12. Such an electromagnetic device may be used to overlap the timing of the strokes of the first piston 120 and the second piston 122 to reduce undesired pulsations thereof.

Thus, as described above, in accordance with some embodiments of the invention, the first plungers and the second plungers in the reciprocating fluid pumps may be operated asynchronously with one another. In additional embodiments, however, the first and second plungers may expand and compress synchronously, either in phase with one another or out of phase with one another. For example, the first and second plungers may operate synchronously, but out of phase from one another by 180°, as previously described with reference to FIGS. 1, 2, 4, and 5.

Although the reciprocating fluid pump 100 of FIGS. 1, 2, 4, and 5 is shown as employing two plungers, additional embodiments of fluid pumps of the present invention may only include a single plunger, or may include more than two plungers. Furthermore, although the reciprocating fluid pump 100 of FIGS. 1, 2, 4, and 5 is shown with plungers at least partially internal to a pump body, additional embodiments of reciprocating fluid pumps of the present invention may include reciprocating fluid pumps with one or more plungers, diaphragms, and/or bellows positioned at least partially external to a pump body.

Additional non-limiting example embodiments of the invention are described below.

Embodiment 1: A reciprocating fluid pump for pumping a subject fluid, comprising: a pump body; at least one subject fluid chamber within the pump body; at least one plunger located at least partially within the pump body, the at least one plunger configured to expand and compress in a reciprocating action to pump fluid through the at least one subject fluid chamber within the pump body during operation of the reciprocating fluid pump; and at least one magnet carried by the at least one plunger, the at least one magnet located and configured to impart a force on the at least one plunger when the at least one plunger expands and compresses in the reciprocating action within the pump body responsive to a magnetic field.

Embodiment 2: The reciprocating fluid pump of Embodiment 1, wherein the at least one magnet comprises at least one permanent magnet.

Embodiment 3: The reciprocating fluid pump of Embodiment 2, wherein the at least one magnet comprises at least one rare earth magnet.

Embodiment 4: The reciprocating fluid pump of Embodiment 3, wherein the at least one rare earth magnet comprises at least one magnet at least substantially comprised of at least one of a samarium cobalt alloy and a neodymium iron alloy.

Embodiment 5: The reciprocating fluid pump of Embodiment 2, wherein the at least one magnet comprises a plurality of permanent magnets.

Embodiment 6: The reciprocating fluid pump of Embodiment 5, wherein each permanent magnet of the plurality of permanent magnets is disposed within at least one wall of the at least one plunger, the permanent magnets of the plurality of permanent magnets being arranged in a predetermined pattern within the at least one wall of the at least one plunger.

Embodiment 7: The reciprocating fluid pump of Embodiment 1, further comprising at least one additional magnet configured to provide the magnetic field.

Embodiment 8: The reciprocating fluid pump of Embodiment 7, wherein the at least one additional magnet comprises at least one permanent magnet.

Embodiment 9: The reciprocating fluid pump of Embodiment 7, wherein the at least one additional magnet comprises an electromagnetic device.

Embodiment 10: The reciprocating fluid pump of Embodiment 7, wherein the at least one additional magnet is disposed at least partially within the pump body.

Embodiment 11: The reciprocating fluid pump of Embodiment 1, wherein the at least one plunger comprises a tubular body having a first closed end and an opposite, second open end, the tubular body comprising an end wall at the first closed end and a sidewall extending from the end wall toward the opposite, second open end of the tubular body, the at least one magnet carried by the end wall at the first closed end of the tubular body.

Embodiment 12: The reciprocating fluid pump of Embodiment 1, further comprising at least one drive fluid chamber within the pump body, the at least one plunger separating the at least one drive fluid chamber from the at least one subject fluid chamber within the pump body.

Embodiment 13: The reciprocating fluid pump of Embodiment 12, wherein: the at least one plunger comprises a first plunger and a second plunger, the first plunger separating a first subject fluid chamber from a first drive fluid chamber and the second plunger separating a second subject fluid chamber from a second drive fluid chamber; each of the first plunger and the second plunger comprises a tubular body having a first closed end and an opposite, second open end, the tubular body comprising an end wall at the first closed end and a sidewall extending from the end wall toward the opposite, second open end of the tubular body; and the at least one magnet comprises a plurality of magnets, a first magnet of the plurality of magnets carried by the first plunger, and a second magnet of the plurality of magnets carried by the second plunger.

Embodiment 14: The reciprocating fluid pump of Embodiment 13, wherein the first magnet and the second magnet are located and oriented in the reciprocating fluid pump to cause a repulsive force between the first magnet and the second magnet when the first plunger and the second plunger expand and compress in the reciprocating action within the pump body responsive to a magnetic field.

Embodiment 15: The reciprocating fluid pump of Embodiment 13, wherein the plurality of magnets comprises: a first set of magnets carried by the first plunger; and a second set of magnets carried by the second plunger.

Embodiment 16: The reciprocating fluid pump of Embodiment 15, wherein the first set of magnets and the second set of magnets are located and oriented respectively on the first plunger and the second plunger to impart radial alignment forces on the first plunger to urge the first plunger into alignment along an axis along which the first plunger expands and compresses in a reciprocating action within the pump body during operation of the reciprocating fluid pump.

Embodiment 17: The reciprocating fluid pump of Embodiment 16, wherein the first set of magnets and the second set of magnets are located and oriented respectively on the first plunger and the second plunger to impart radial alignment forces on the second plunger to urge the second plunger into alignment along an axis along which the second plunger expands and compresses in a reciprocating action within the pump body during operation of the reciprocating fluid pump.

Embodiment 18: The reciprocating fluid pump of Embodiment 1, further comprising: at least one subject fluid inlet; at least one subject fluid outlet; at least one subject fluid inlet check valve positioned proximate the at least one subject fluid inlet and configured to allow the fluid to flow into the at least one subject fluid chamber; and at least one subject fluid outlet check valve positioned proximate the at least one subject fluid outlet and configured to allow the fluid to flow out of the at least one subject fluid chamber.

Embodiment 19: The reciprocating fluid pump of Embodiment 18, wherein each of the at least one subject fluid inlet check valve and the at least one subject fluid outlet check valve comprises a magnet check valve comprising: a valve housing; a ball within the valve housing, the ball comprising an internal magnet; and an external magnet configured to magnetically force the ball against a valve seat of the valve housing to restrict flow through the valve housing in at least one direction.

Embodiment 20: The reciprocating fluid pump of Embodiment 1, further comprising at least one magnetic field baffle disposed within the pump body and configured to alter a magnetic field provided by the at least one magnet.

Embodiment 21: The reciprocating fluid pump of Embodiment 1, wherein the pump body at least substantially comprises a non-magnetic material.

Embodiment 22: A reciprocating fluid pump for pumping a subject fluid, comprising: a pump body; a first plunger separating a first subject fluid chamber from a first drive fluid chamber within the pump body; a first magnet carried by the first plunger; a second plunger separating a second subject fluid chamber from a second drive fluid chamber within the pump body; and a second magnet carried by the second plunger.

Embodiment 23: The reciprocating fluid pump of Embodiment 22, wherein the first magnet and the second magnet are located and oriented to impart repulsive forces on the first plunger and the second plunger as the first plunger and the second plunger are brought into proximity with one another during operation of the reciprocating fluid pump.

Embodiment 24: The reciprocating fluid pump of Embodiment 22, further comprising another magnet disposed within the pump body, wherein the first magnet and the another magnet are located and oriented to impart a repulsive force on the first plunger as the first plunger is brought into proximity with the another magnet during operation of the reciprocating fluid pump.

Embodiment 25: The reciprocating fluid pump of Embodiment 24, wherein the second magnet and the another magnet are located and oriented to impart a repulsive force on the second plunger as the second plunger is brought into proximity with the another magnet during operation of the reciprocating fluid pump.

Embodiment 26: The reciprocating fluid pump of Embodiment 22, wherein each of the first plunger and the second plunger comprises a tubular body having a first closed end and an opposite, second open end, the tubular body comprising an end wall at the first closed end and a sidewall extending from the end wall toward the opposite, second open end of the tubular body.

Embodiment 27: The reciprocating fluid pump of Embodiment 26, wherein the first plunger and the second plunger are capable of moving independently relative to one another.

Embodiment 28: The reciprocating fluid pump of Embodiment 26, wherein the end wall of the tubular body of the first plunger is not structurally coupled to the end wall of the tubular body of the second plunger by a shaft.

Embodiment 29: A shuttle valve for shifting flow of pressurized fluid between at least two conduits, comprising: a valve body; a spool disposed within the valve body and configured to move between a first position and a second position within the valve body; a fluid inlet; a first fluid outlet and a second fluid outlet, fluid communication provided between the fluid inlet and the first fluid outlet and precluded between the fluid inlet and the second fluid outlet when the spool is disposed in the first position within the valve body, fluid communication provided between the fluid inlet and the second fluid outlet and precluded between the fluid inlet and the first fluid outlet when the spool is disposed in the second position within the valve body; and at least one magnet carried by the spool, the at least one magnet located and configured to impart a force on the spool responsive to a magnetic field.

Embodiment 30: The shuttle valve of Embodiment 29, wherein the at least one magnet is located and configured to bias the spool to at least one of the first position and the second position within the valve body responsive to the magnetic field.

Embodiment 31: The shuttle valve of Embodiment 29, wherein the at least one magnet comprises at least one permanent magnet.

Embodiment 32: The shuttle valve of Embodiment 29, further comprising at least one additional magnet configured to provide the magnetic field.

Embodiment 33: The shuttle valve of Embodiment 32, wherein the at least one additional magnet comprises at least one permanent magnet.

Embodiment 34: The shuttle valve of Embodiment 32, wherein the at least one additional magnet comprises an electromagnetic device.

Embodiment 35: The shuttle valve of Embodiment 32, wherein the at least one additional magnet is disposed at least partially within the valve body.

Embodiment 36: The shuttle valve of Embodiment 29, wherein the spool comprises an elongated body having a first end and an opposite, second end.

Embodiment 37: The shuttle valve of Embodiment 36, wherein the at least one magnet is disposed proximate at least one of the first end and the opposite, second end of the elongated body.

Embodiment 38: A reciprocating fluid pump for pumping a subject fluid, comprising: a pump body; at least one subject fluid chamber within the pump body; at least one drive fluid chamber within the pump body; at least one plunger located at least partially within the pump body and separating the at least one subject fluid chamber from the at least one drive fluid chamber, the at least one plunger configured to expand and compress in a reciprocating action responsive to pressurization and depressurization of a drive fluid within the at least one drive fluid chamber to pump subject fluid through the at least one subject fluid chamber within the pump body during operation of the reciprocating fluid pump; and a shuttle valve for shifting flow of pressurized drive fluid between at least two conduits, at least one conduit of the at least two conduits leading to the at least one drive fluid chamber, the shuttle valve comprising: a valve body; a spool disposed within the valve body and configured to move between a first position and a second position within the valve body; a fluid inlet; a first fluid outlet and a second fluid outlet, fluid communication provided between the fluid inlet and the first fluid outlet and precluded between the fluid inlet and the second fluid outlet when the spool is disposed in the first position within the valve body, fluid communication provided between the fluid inlet and the second fluid outlet and precluded between the fluid inlet and the first fluid outlet when the spool is disposed in the second position within the valve body; and at least one magnet carried by the spool, the at least one magnet located and configured to impart a force on the spool responsive to a magnetic field.

Embodiment 39: The reciprocating fluid pump of Embodiment 38, further comprising at least one additional magnet carried by the at least one plunger, the at least one additional magnet located and configured to impart a force on the at least one plunger when the at least one plunger expands and compresses in the reciprocating action within the pump body responsive to another magnetic field.

Embodiment 40: A method of forming a reciprocating fluid pump, comprising: forming at least one subject fluid chamber within a pump body; providing at least one plunger at least partially within the pump body and configuring the at least one plunger to expand and compress in a reciprocating action to pump fluid through the at least one subject fluid chamber within the pump body during operation of the reciprocating fluid pump; and attaching at least one magnet to the at least one plunger and locating and orienting the at least one magnet to impart a force on the at least one plunger when the at least one plunger expands and compresses in the reciprocating action within the pump body responsive to a magnetic field.

Embodiment 41: The method of Embodiment 40, further comprising providing the magnetic field.

Embodiment 42: The method of Embodiment 41, wherein providing the magnetic field comprises providing another magnet within the pump body.

Embodiment 43: The method of Embodiment 42, wherein providing the another magnet within the pump body comprises providing the another magnet at a fixed location within the pump body.

Embodiment 44: The method of Embodiment 43, wherein providing the another magnet within the pump body comprises attaching the another magnet to another plunger at least partially within the pump body.

Embodiment 45: A method of forming a shuttle valve for shifting flow of pressurized fluid between at least two conduits, comprising: attaching a magnet to a spool; disposing the spool within a valve body and configuring the spool to be movable within the valve body between a first position and a second position; configuring the spool and the valve body to provide fluid communication between a fluid inlet and a first fluid outlet and to preclude fluid communication between the fluid inlet and a second fluid outlet when the spool is disposed in the first position within the valve body; and configuring the spool and the valve body to provide fluid communication between the fluid inlet and the second fluid outlet and to preclude fluid communication between the fluid inlet and the first fluid outlet when the spool is disposed in the second position within the valve body.

Embodiment 46: The method of Embodiment 45, further comprising providing a magnetic field in a region encompassing the magnet.

Embodiment 47: The method of Embodiment 46, wherein providing a magnetic field in the region encompassing the magnet comprises attaching another magnet to the valve body.

Embodiment 48: The method of Embodiment 46, wherein providing a magnetic field in a region encompassing the magnet comprises biasing the spool to one of the first position and the second position.

Embodiment 49: A method of forming a reciprocating fluid pump, comprising: providing a shuttle valve, comprising: providing a spool within a valve body and configuring the spool to move between a first position and a second position within the valve body; configuring the spool and the valve body to provide fluid communication between a fluid inlet and a first fluid outlet and to preclude fluid communication between the fluid inlet and the second fluid outlet when the spool is disposed in the first position within the valve body; configuring the spool and the valve body to provide fluid communication between the fluid inlet and the second fluid outlet and to preclude fluid communication between the fluid inlet and the first fluid outlet when the spool is disposed in the second position within the valve body; and attaching at least one magnet to the spool and locating and orienting the at least one magnet to impart a force on the spool responsive to a magnetic field; providing at least one plunger at least partially within a pump body between at least one subject fluid chamber and at least one drive fluid chamber; and establishing fluid communication between the drive fluid chamber and at least one of the first fluid outlet and the second fluid outlet of the shuttle valve.

Embodiment 50: The method of Embodiment 49, further comprising providing the magnetic field.

Embodiment 51: The method of Embodiment 50, wherein providing the magnetic field comprises attaching another magnet to the valve body.

Embodiment 52: A method of pumping a fluid, comprising: extending a plunger within a pump body and drawing a subject fluid into a subject fluid chamber within the pump body responsive to extending the plunger within the pump body; compressing the plunger within the pump body and expelling a subject fluid from the subject fluid chamber within the pump body responsive to compressing the plunger within the pump body; and exerting a force on the plunger using a magnet carried by the plunger and a magnetic field.

Embodiment 53: The method of claim 52, further comprising extending another plunger carrying another magnet within the pump body and drawing a subject fluid into another chamber within the pump body responsive to extending the another plunger within the pump body, wherein exerting a force on the plunger using a magnet carried by the plunger and a magnetic field comprises providing the magnetic field with an electromagnetic device and timing the magnetic field to encourage asynchronous extension and compression of the plunger and the another plunger.

CONCLUSION

In some embodiments, the present invention includes reciprocating fluid pumps for pumping a subject fluid that include a pump body, at least one subject fluid chamber within the pump body, at least one plunger located at least partially within the pump body, and at least one magnet carried by the at least one plunger. The at least one plunger is configured to expand and compress in a reciprocating action to pump fluid through the at least one subject fluid chamber within the pump body during operation of the reciprocating fluid pump. The at least one magnet is located and configured to impart a motive force on the at least one plunger responsive to an adjacent magnetic field during at least one of the expansion and contraction of the at least one plunger in the reciprocating action thereof within the pump body.

In additional embodiments, the present invention includes reciprocating fluid pumps for pumping a subject fluid that include a pump body, a first plunger separating a first subject fluid chamber from a first drive fluid chamber within the pump body, a first magnet carried by the first plunger, a second plunger separating a second subject fluid chamber from a second drive fluid chamber within the pump body, and a second magnet carried by the second plunger.

In additional embodiments, the present invention includes shuttle valves for shifting flow of pressurized fluid between at least two conduits. The shuttle valves include a valve body, a spool disposed within the valve body and configured to move between a first position and a second position within the valve body, a fluid inlet, a first fluid outlet, and a second fluid outlet. Fluid communication is provided between the fluid inlet and the first fluid outlet and precluded between the fluid inlet and the second fluid outlet when the spool is disposed in the first position within the valve body. Fluid communication is provided between the fluid inlet and the second fluid outlet and precluded between the fluid inlet and the first fluid outlet when the spool is disposed in the second position within the valve body. The shuttle valves further include at least one magnet carried by the spool. The at least one magnet is located and configured to impart a motive force on the spool responsive to an adjacent magnetic field.

In yet further embodiments, the present invention includes reciprocating fluid pumps for pumping a subject fluid that include a pump body, at least one subject fluid chamber within the pump body, at least one drive fluid chamber within the pump body, and at least one plunger located at least partially within the pump body and separating the at least one subject fluid chamber from the at least one drive fluid chamber. The at least one plunger is configured to expand and compress in a reciprocating action responsive to pressurization and depressurization of a drive fluid within the at least one drive fluid chamber to pump subject fluid through the at least one subject fluid chamber within the pump body during operation of the reciprocating fluid pump. The pumps further include a shuttle valve for shifting flow of pressurized drive fluid between at least two conduits, at least one conduit of the at least two conduits leading to the at least one drive fluid chamber. The shuttle valve includes a valve body, a spool disposed within the valve body and configured to move between a first position and a second position within the valve body, a fluid inlet, a first fluid outlet and a second fluid outlet. Fluid communication is provided between the fluid inlet and the first fluid outlet and precluded between the fluid inlet and the second fluid outlet when the spool is disposed in the first position within the valve body. Fluid communication is provided between the fluid inlet and the second fluid outlet and precluded between the fluid inlet and the first fluid outlet when the spool is disposed in the second position within the valve body. At least one magnet is carried by the spool. The at least one magnet is located and configured to impart a motive force on the spool responsive to an adjacent magnetic field.

Additional embodiments of the invention include methods of forming reciprocating fluid pumps. In accordance with such methods, at least one subject fluid chamber is formed within a pump body, at least one plunger is provided at least partially within the pump body and configured to expand and compress in a reciprocating action to pump fluid through the at least one subject fluid chamber within the pump body during operation of the reciprocating fluid pump. At least one magnet is attached to the at least one plunger and located and oriented to impart a motive force on the at least one plunger when the at least one plunger expands and compresses in the reciprocating action within the pump body responsive to an adjacent magnetic field.

Yet further embodiments of the invention include methods of forming shuttle valves for shifting flow of pressurized fluid between at least two conduits. In accordance with such methods, a magnet is attached to a spool, and the spool is disposed within a valve body and configured to be movable within the valve body between a first position and a second position. The spool and the valve body are configured to provide fluid communication between a fluid inlet and a first fluid outlet and to preclude fluid communication between the fluid inlet and a second fluid outlet when the spool is disposed in the first position within the valve body. The spool and the valve body are further configured to provide fluid communication between the fluid inlet and the second fluid outlet and to preclude fluid communication between the fluid inlet and the first fluid outlet when the spool is disposed in the second position within the valve body.

Additional embodiments of the invention include methods of pumping a fluid, in which a plunger is extended within a pump body and a subject fluid is drawn into a subject fluid chamber within the pump body responsive to extending the plunger within the pump body. The plunger is compressed within the pump body and a subject fluid is expelled from the subject fluid chamber within the pump body responsive to compressing the plunger within the pump body. A motive force is exerted on the plunger using a magnet carried by the plunger and a magnetic field proximate the magnet.

Thus, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. For example, elements or features described in relation to one embodiment may be implemented into other embodiments without departing from the scope of the invention. The scope of the invention, therefore, is only limited by the claims and their legal equivalents.

What is claimed is:

1. A reciprocating fluid pump for pumping a subject fluid, comprising:

a pump body;

a first subject fluid chamber within the pump body;

a second subject fluid chamber within the pump body;

a first plunger located at least partially within the pump body, the first plunger comprising a flexible material and configured to expand and compress in a reciprocating action to pump subject fluid through the first subject fluid chamber within the pump body during operation of the reciprocating fluid pump;

a second plunger located at least partially within the pump body, the second plunger comprising a flexible material and configured to expand and compress in a reciprocating action to pump subject fluid through the second subject fluid chamber within the pump body during operation of the reciprocating fluid pump;

at least one first magnet disposed within the first plunger; and at least one second magnet disposed within the second plunger;

wherein the at least one first magnet and the at least one second magnet are located and configured to impart a force on each other during at least one of the expansion and compression of the first plunger and second plunger in the reciprocating action within the pump body; and wherein the first plunger is not structurally coupled to the second plunger, such that the first plunger and the second plunger are independently movable during operation.

2. The reciprocating fluid pump of claim 1, wherein each of the at least one first magnet and the at least one second magnet comprises at least one permanent magnet.

3. The reciprocating fluid pump of claim 2, wherein the at least one permanent magnet comprises at least one rare earth magnet.

4. The reciprocating fluid pump of claim 3, wherein the at least one rare earth magnet comprises at least one magnet comprised of at least one of a samarium cobalt alloy and a neodymium iron alloy.

5. The reciprocating fluid pump of claim 2, wherein the at least one first magnet comprises a first plurality of permanent magnets.

6. The reciprocating fluid pump of claim 5, wherein each permanent magnet of the first plurality of permanent magnets is disposed within at least one wall of the first plunger, the first plurality of permanent magnets being arranged in a predetermined pattern within the at least one wall of the first plunger.

7. The reciprocating fluid pump of claim 1, further comprising at least one additional magnet configured to provide a magnetic field to at least one of the first magnet and the second magnet.

8. The reciprocating fluid pump of claim 7, wherein the at least one additional magnet comprises at least one permanent magnet.

9. The reciprocating fluid pump of claim 7, wherein the at least one additional magnet comprises an electromagnetic device.

10. The reciprocating fluid pump of claim 7, wherein the at least one additional magnet is disposed at least partially within the pump body.

11. The reciprocating fluid pump of claim 1, wherein the at least one plunger comprises a tubular body having a first closed end and an opposite, second open end, the tubular body comprising an end wall at the first closed end and a sidewall extending from the end wall toward the opposite, second open end of the tubular body, the at least one magnet being carried by the end wall at the first closed end of the tubular body.

12. The reciprocating fluid pump of claim 1, wherein: the first plunger separates a first subject fluid chamber from a first drive fluid chamber and the second plunger separates a second subject fluid chamber from a second drive fluid chamber.

13. The reciprocating fluid pump of claim 12, wherein:

each of the first plunger and the second plunger comprises a tubular body having a first closed end and an opposite, second open end, the tubular body of the first plunger and the tubular body of the second plunger each comprising an end wall at the first closed end and a sidewall extending from the end wall toward the opposite, second open end thereof.

14. The reciprocating fluid pump of claim 13, wherein the at least one first magnet and the at least one second magnet are located and oriented in the reciprocating fluid pump to cause a repulsive force between the at least one first magnet and the at least one second magnet when the first plunger and the second plunger expand and compress in the reciprocating action within the pump body.

15. The reciprocating fluid pump of claim 13, wherein:

the at least one first magnet comprises a first set of magnets carried by the first plunger; and the at least one second magnet comprises a second set of magnets carried by the second plunger.

16. The reciprocating fluid pump of claim 15, wherein the first set of magnets and the second set of magnets are located and oriented respectively on the first plunger and the second plunger to impart radial alignment forces on the first plunger to urge the first plunger into alignment along an axis along which the first plunger expands and compresses in a reciprocating action within the pump body during operation of the reciprocating fluid pump.

17. The reciprocating fluid pump of claim 16, wherein the first set of magnets and the second set of magnets are located and oriented respectively on the first plunger and the second plunger to impart radial alignment forces on the second plunger to urge the second plunger into alignment along an axis along which the second plunger expands and compresses in a reciprocating action within the pump body during operation of the reciprocating fluid pump.

18. The reciprocating fluid pump of claim 1, further comprising:

at least one subject fluid inlet;

at least one subject fluid outlet;

at least one subject fluid inlet check valve positioned proximate the at least one subject fluid inlet and configured to allow the subject fluid to flow into the at least one subject fluid chamber therethrough and to restrict the subject fluid from flowing out of the at least one subject fluid chamber therethrough; and at least one subject fluid outlet check valve positioned proximate the at least one subject fluid outlet and configured to allow the subject fluid to flow out of the at least one subject fluid chamber therethrough and to restrict the subject fluid from flowing into the at least one subject fluid chamber therethrough.

19. The reciprocating fluid pump of claim 18, wherein each of the at least one subject fluid inlet check valve and the at least one subject fluid outlet check valve comprises a magnet check valve comprising:

a valve housing;

a ball within the valve housing, the ball comprising an internal magnet surrounded by a non-magnetic material; and an external magnet configured to magnetically force the ball against a valve seat of the valve housing to restrict flow through the valve housing in at least one direction.

20. The reciprocating fluid pump of claim 1, further comprising at least one magnetic field baffle disposed within the pump body and configured to alter a magnetic field provided by the at least one first magnet and the at least one second magnet such that the force imparted between the at least one first magnet and the at least one second magnet decreases more quickly with increased distance therebetween relative to a configuration without the magnetic field baffle.

21. The reciprocating fluid pump of claim 1, wherein the pump body consists of a non-magnetic material.

22. The reciprocating fluid pump of claim 1, wherein the at least one first magnet and the at least one second magnet are located along and centered about a common axis along which the first plunger and the second plunger expand and compress.

23. A reciprocating fluid pump for pumping a subject fluid, comprising:

a pump body;

at least one subject fluid chamber within the pump body;

at least one drive fluid chamber within the pump body;

at least one plunger located at least partially within the pump body and separating the at least one subject fluid chamber from the at least one drive fluid chamber, the at least one plunger configured to expand and compress in a reciprocating action responsive to pressurization and depressurization of drive fluid within the at least one drive fluid chamber to pump subject fluid through the at least one subject fluid chamber within the pump body during operation of the reciprocating fluid pump; and a shuttle valve for shifting flow of pressurized drive fluid between at least two conduits, at least one conduit of the at least two conduits leading to the at least one drive fluid chamber, the shuttle valve comprising:

a valve body;

a spool disposed within the valve body and configured to move between a first position and a second position within the valve body;

a drive fluid inlet;

a first drive fluid outlet and a second drive fluid outlet, fluid communication provided between the drive fluid inlet and the first drive fluid outlet and precluded between the drive fluid inlet and the second drive fluid outlet when the spool is disposed in the first position within the valve body, fluid communication provided between the drive fluid inlet and the second drive fluid outlet and precluded between the drive fluid inlet and the first drive fluid outlet when the spool is disposed in the second position within the valve body; and at least one magnet carried by the spool, the at least one magnet located and configured to impart a force on the spool responsive to a magnetic field such that the spool is magnetically biased to only one of the first position and the second position throughout a stroke of the spool from the first position to the second position.

24. The reciprocating fluid pump of claim 23, further comprising at least one additional magnet disposed within the at least one plunger, the at least one additional magnet located and configured to impart a force on the at least one plunger when the at least one plunger expands and compresses in the reciprocating action within the pump body responsive to another magnetic field.

25. A method of forming a reciprocating fluid pump, comprising:

providing a shuttle valve, comprising:

providing a spool within a valve body and configuring the spool to move between a first position and a second position within the valve body;

configuring the spool and the valve body to provide fluid communication between a drive fluid inlet and a first drive fluid outlet and to preclude fluid communication between the drive fluid inlet and the second drive fluid outlet when the spool is disposed in the first position within the valve body;

configuring the spool and the valve body to provide fluid communication between the drive fluid inlet and the second drive fluid outlet and to preclude fluid communication between the drive fluid inlet and the first drive fluid outlet when the spool is disposed in the second position within the valve body; and attaching at least one magnet to the spool and locating and orienting the at least one magnet to impart a force on the spool responsive to a magnetic field such that the spool is magnetically biased to only one of the first position and the second position throughout a stroke of the spool from the first position to the second position;

providing at least one plunger at least partially within a pump body between at least one subject fluid chamber and at least one drive fluid chamber; and establishing fluid communication between the drive fluid chamber and at least one of the first drive fluid outlet and the second drive fluid outlet of the shuttle valve.

26. The method of claim 25, further comprising providing the magnetic field.

27. The method of claim 26, wherein providing the magnetic field comprises attaching another magnet to the valve body.

* * * * *